US008752718B2

(12) United States Patent
Stukenberg et al.

(10) Patent No.: US 8,752,718 B2
(45) Date of Patent: Jun. 17, 2014

(54) END FRAME FOR DISPLAY STRUCTURE

(75) Inventors: Joseph R. Stukenberg, Minneapolis, MN (US); Jennifer A. Theisen, Crystal, MN (US); Scott E. Denby, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 117 days.

(21) Appl. No.: 13/460,435

(22) Filed: Apr. 30, 2012

(65) Prior Publication Data

US 2013/0284684 A1 Oct. 31, 2013

(51) Int. Cl.
*A47F 5/08* (2006.01)

(52) U.S. Cl.
USPC ..... 211/87.01

(58) Field of Classification Search
USPC ..... 211/54.1, 57.1, 59.1, 59.2, 87.01, 107, 211/113, 119.003, 187, 189, 190, 192, 196, 211/207, 208; 248/220.31, 220.41, 224.8, 248/243; 40/607.07, 611.05, 611.06, 649; 108/106–110; D6/567
See application file for complete search history.

(56) References Cited

U.S. PATENT DOCUMENTS

| | | | | |
|---|---|---|---|---|
| 2,772,846 | A | | 12/1956 | Skar |
| 2,925,920 | A | | 2/1960 | Skubic |
| 2,998,107 | A | | 8/1961 | Zimmerla |
| 3,085,694 | A | | 4/1963 | Jones |
| 3,148,638 | A | | 9/1964 | Shelor |
| 3,234,897 | A | | 2/1966 | Berk |
| 3,297,374 | A | | 1/1967 | Radek |
| 3,329,282 | A | * | 7/1967 | Swan et al. ..... 211/190 |
| 3,346,124 | A | | 10/1967 | Sobel |
| 3,492,772 | A | * | 2/1970 | Bergman ..... 52/633 |
| 3,517,623 | A | | 6/1970 | Goldstein et al. |
| 3,877,395 | A | | 4/1975 | Sobel |
| 4,046,083 | A | | 9/1977 | Murdoch et al. |
| 4,406,374 | A | | 9/1983 | Yedor |
| 4,886,235 | A | | 12/1989 | Thornborrow |
| 5,069,408 | A | | 12/1991 | Bessinger |
| 5,370,249 | A | | 12/1994 | Harvey et al. |
| 5,505,319 | A | * | 4/1996 | Todd, Jr. ..... 211/95 |
| 5,560,580 | A | | 10/1996 | Almoslino |
| 5,660,286 | A | * | 8/1997 | Shea ..... 211/87.01 |
| 5,722,623 | A | * | 3/1998 | Gibson ..... 248/201 |
| 5,832,644 | A | * | 11/1998 | Mason ..... 40/642.02 |
| 5,921,411 | A | | 7/1999 | Merl |
| 5,933,992 | A | * | 8/1999 | Padiak et al. ..... 40/606.15 |
| D419,338 | S | | 1/2000 | Battaglia |
| RE36,669 | E | * | 4/2000 | Zilincar, III ..... 211/86.01 |
| 6,070,747 | A | * | 6/2000 | Shea ..... 211/87.01 |

(Continued)

*Primary Examiner* — Joshua Rodden
(74) *Attorney, Agent, or Firm* — Griffiths & Seaton PLLC; JoAnn M. Seaton

(57) ABSTRACT

An end frame assembly, for use with a display unit including a post having at least one aperture formed through each of two opposing surfaces of the post, including an end frame, a first stationary plate coupled to the end frame, a second stationary plate coupled to the end frame and spaced from and extending substantially coplanarly with respect to the first stationary plate, and a first slide plate disposed over the first stationary plate and including a first tab capable of fitting within one of the apertures formed through one of the two opposing surfaces of the post. The first slide plate is selectively coupled with the first stationary plate via at least a first fastener, and the first fastener is selectively releasable to selectively allow linear movement of the first slide plate and selectively securable to hold the first slide plate in a substantially static position.

20 Claims, 20 Drawing Sheets

(56) References Cited

U.S. PATENT DOCUMENTS

| | | | | |
|---|---|---|---|---|
| 6,164,467 | A | 12/2000 | DePottey et al. | |
| 6,196,141 | B1 | 3/2001 | Herron, III et al. | |
| 6,199,706 | B1 * | 3/2001 | Shea | 211/87.01 |
| 6,206,212 | B1 * | 3/2001 | Loew | 211/189 |
| 6,427,855 | B2 * | 8/2002 | LaBruna et al. | 211/87.01 |
| D465,371 | S * | 11/2002 | Shea | D6/567 |
| D466,352 | S * | 12/2002 | Shea | D6/567 |
| 6,533,134 | B1 * | 3/2003 | Menaged et al. | 211/87.01 |
| 6,536,613 | B2 * | 3/2003 | Shea | 211/87.01 |
| 6,644,609 | B1 | 11/2003 | Scott | |
| 6,663,201 | B2 | 12/2003 | Herron, III et al. | |
| 6,976,598 | B2 | 12/2005 | Engel | |
| D544,730 | S | 6/2007 | Stukenberg | |
| 7,234,604 | B2 | 6/2007 | Eisele | |
| 7,255,237 | B2 | 8/2007 | Stitchick et al. | |
| D554,919 | S | 11/2007 | Clark et al. | |
| D571,131 | S | 6/2008 | Clark et al. | |
| D615,389 | S | 5/2010 | Shinozaki | |
| D615,390 | S | 5/2010 | Shinozaki | |
| 7,798,342 | B2 * | 9/2010 | Pustinger et al. | 211/119.003 |
| 7,886,919 | B2 | 2/2011 | Battaglia, Jr. et al. | |
| D655,533 | S | 3/2012 | Denby et al. | |
| 8,231,016 | B2 * | 7/2012 | Berdahl et al. | 211/119.003 |
| 8,534,627 | B2 * | 9/2013 | Kressin | 248/307 |
| 2002/0175132 | A1 * | 11/2002 | Shea | 211/87.01 |
| 2006/0091095 | A1 * | 5/2006 | Brennan et al. | 211/113 |
| 2010/0320164 | A1 | 12/2010 | Clark et al. | |
| 2011/0266406 | A1 * | 11/2011 | Westimayer et al. | 248/224.8 |

* cited by examiner

END FRAME FOR DISPLAY STRUCTURE

BACKGROUND OF THE INVENTION

Various configurations of display structures are used for displaying different types and styles of products and product packages, for example, in a retail setting. One type of display structure includes a rack used for hanging clothing products disposed on a hanger and/or a shelf for supporting products thereon. Another type of display structure includes a rack, a panel attached to the rack, and support rods coupled to the panel. Small items, such as accessories, jewelry, gift cards, and computer products, are attached to backers having openings for hanging the product from the support rods.

To attract customer attention, in some cases, the display structures include signage or other conspicuous indicia. In addition to attracting attention, still other display structures promote customer interest by including aesthetically attractive components or interactive displays, such as rotating panels or racks or digital interactive displays. Because space is often limited in retail stores, display space is at a premium.

SUMMARY OF THE INVENTION

One embodiment of the present invention relates to an end frame assembly for use with a display unit including a post having at least one aperture formed through each of two opposing surfaces of the post. The connection assembly comprises an end frame having a lower support member, a first stationary plate coupled to the lower support member, a second stationary plate coupled to the lower support member and spaced from and extending substantially coplanarly with respect to the first stationary plate, and a first slide plate disposed over the first stationary plate and including a first tab configured to fit within one of the at least one aperture formed through one of the two opposing surfaces of the post. The first slide plate is selectively coupled with the first stationary plate via at least a first fastener, and the first fastener is selectively releasable to selectively allow linear movement of the first slide plate relative to the first stationary plate and the post and selectively securable to hold the first slide plate in a substantially static position relative to the first stationary plate. The end frame assembly further includes a second slide plate disposed over the second stationary plate and includes a second tab configured to fit within one of the at least one aperture formed through the other one of the two opposing surfaces of the post. Each of the first tab and the second tab is positioned on an end of a corresponding one of the first slide plate and the second slide plate nearest the other of the first slide plate and the second slide plate. Other assemblies, frames, and methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
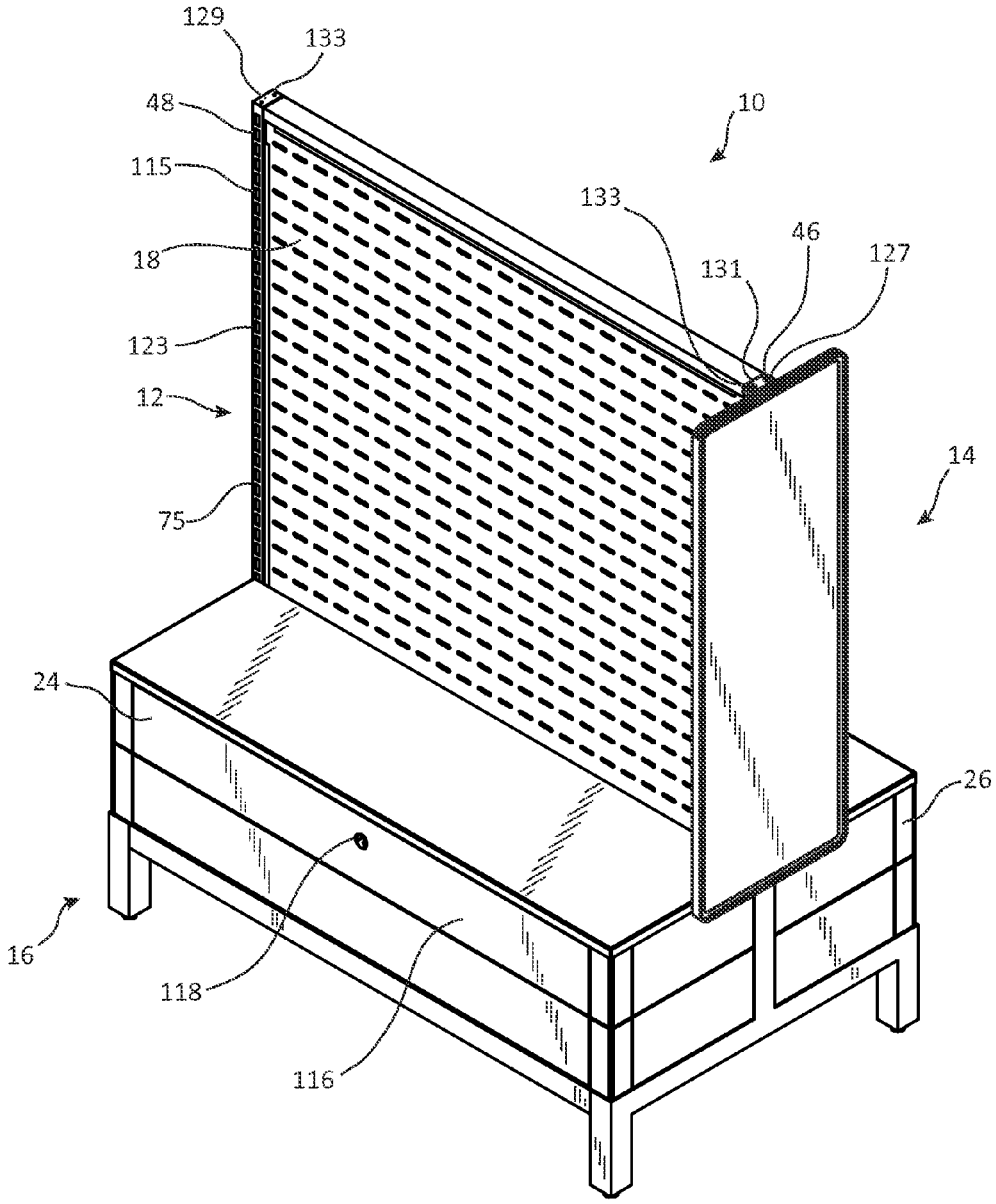
FIG. 1 is a front, perspective view illustration of a display structure, according to one embodiment of the present invention.
Figure 2:
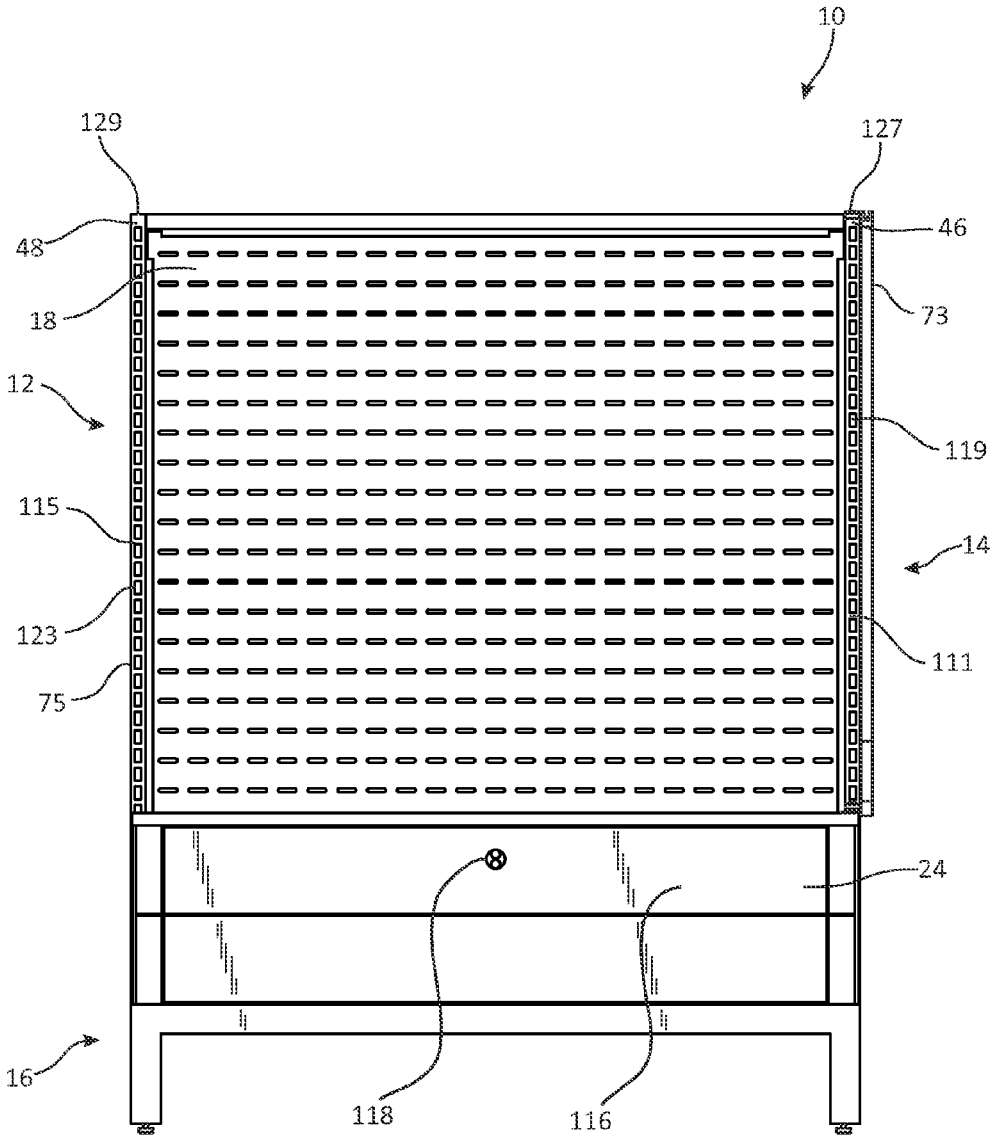
FIG. 2 is a front view illustration of the display structure of FIG. 1, according to one embodiment of the present invention.
Figure 3:
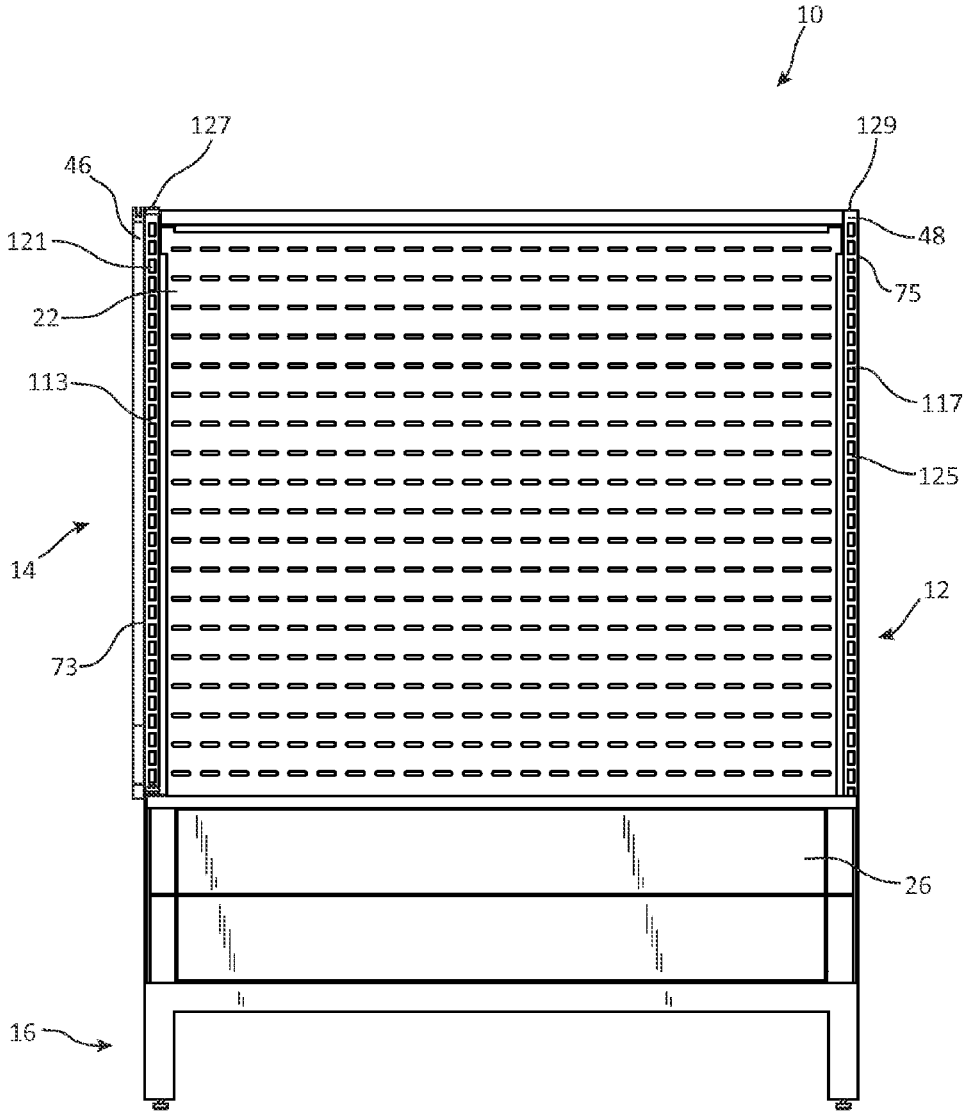
FIG. 3 is a rear view illustration of the display structure of FIG. 1, according to one embodiment of the present invention.
Figure 4:
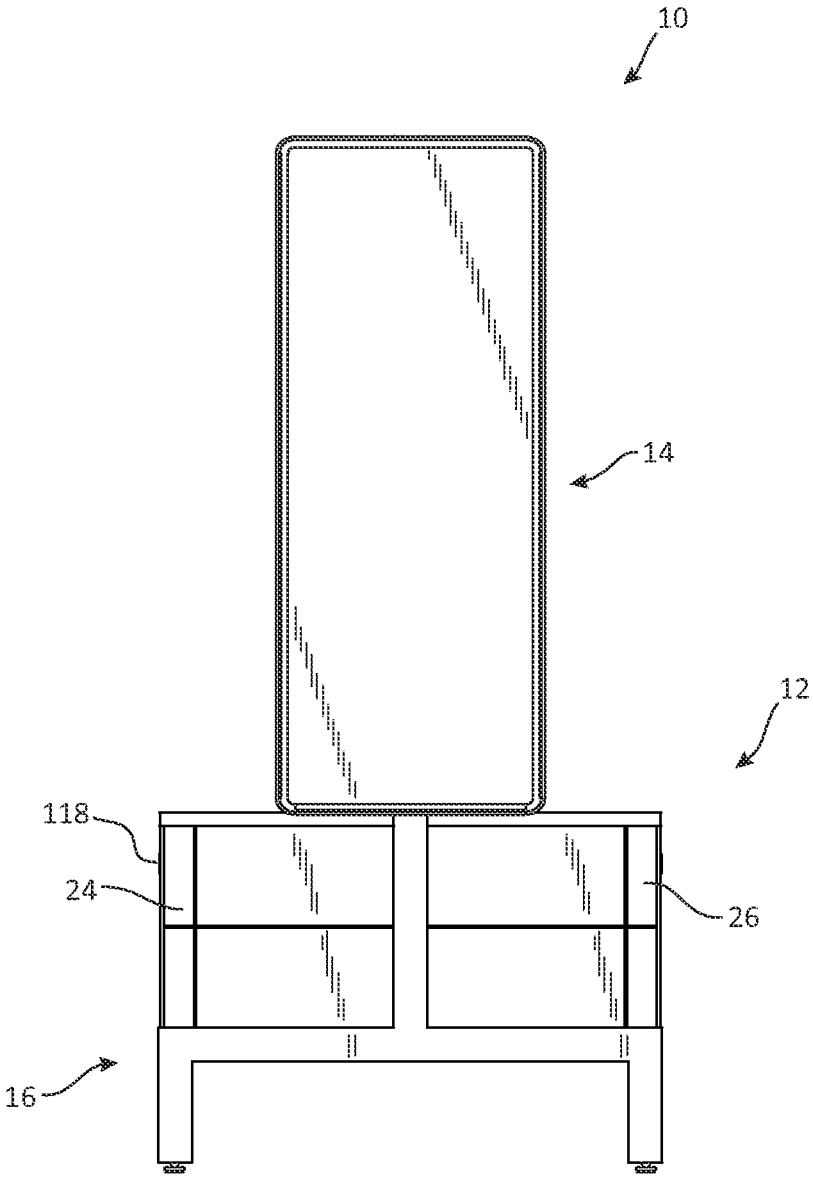
FIG. 4 is a right side view illustration of the display structure of FIG. 1, according to one embodiment of the present invention.
Figure 5:
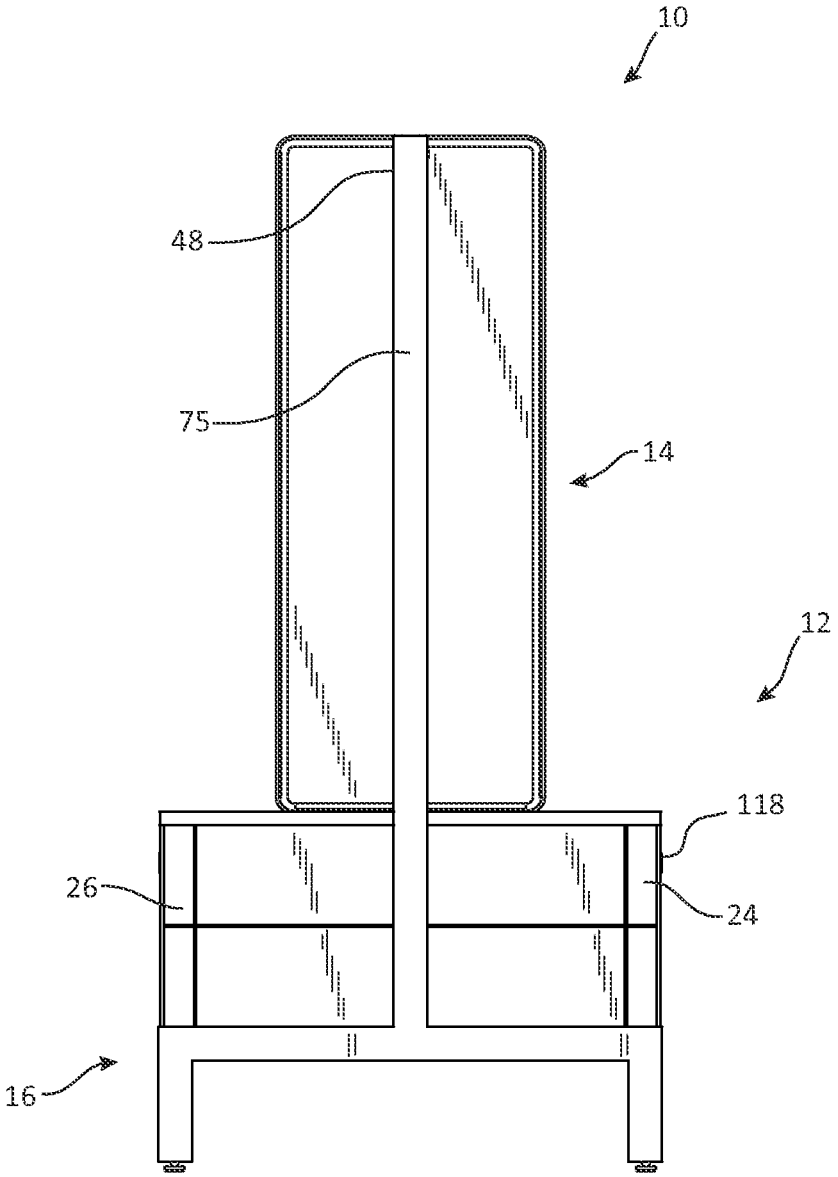
FIG. 5 is a left side view illustration of the display structure of FIG. 1, according to one embodiment of the present invention.

The following detailed description of the invention provides examples and is not intended to limit the invention or the application and uses of the invention. Furthermore, there is no intention to be bound by any theory presented in the preceding background of the invention or the following detailed description of the invention.

Embodiments of the present invention are configured to provide end frames that increase display area and/or improve the visual appearance of conventional display structures. The versatile end frames are hung onto the ends of a display structure unit and can be used with variously configured display structure units. In this regard, the end frames can include connection mechanisms that attach to display structures of varying sizes and/or configurations.

According to one embodiment, the connection mechanisms include two horizontal plates that extend axially from a bottom edge of the end frame. The plates are spaced apart from each other to provide a space for receiving a width of a vertical beam of the display structure. In some embodiments, the distance between the horizontal plates is wider than the width of the vertical beam. Corresponding slide plates are disposed over each horizontal plate. Thus, when one of the slide plates is slid along the length of a horizontal plate toward the vertical beam, the slide plate engages a vertically extending surface of the vertical beam. Likewise, when the other slide plate is slid along the length of the other horizontal plate toward the vertical beam, the other slide plate engages an opposite vertically extending surface of the vertical beam.

With reference now to FIGS. 1-6, a display structure 10 is illustrated. Display structure 10 includes a vertical display unit 12 and an end frame assembly 14 (otherwise referred to as auxiliary display assembly). In one embodiment, vertical display unit 12 supports attachment features for displaying product 13 (see FIG. 26) and/or vertical display unit 12 provides compartments for storing product. According to an embodiment, vertical display unit 12 includes a support frame 16, one or more boards 18, 20, and 22, and one or more bunkers 24 and 26. In one example, bunkers 24 and 26 are eliminated from vertical display unit 12.

Referring to the embodiments illustrated in FIGS. 1-6, support frame 16 supports support boards 18, 20, and 22 and bunkers 24 and 26. In this regard, support frame 16 includes a pair of end posts or substantially vertically extending supports 30 and 32 and a pair of substantially horizontal beams or substantially horizontally extending supports 34 and 36. In one example, each component is separately formed, and then the components are assembled and fastened together to form support frame 16. Alternatively, end posts 30 and 32 and support bars 38 and 40 are formed as a single component, and substantially horizontal beams 34 and 36 are separately attached so that one or more of support boards 18, 20, and 22 can be selectively inserted between or removed from end posts 30 and 32 as will be further described below. The components of support frame 16 are made of materials, such as metal, plastic, wood, or other materials suitable for providing a robust structure.

End posts 30 and 32 are configured to be substantially similar to each other. Each of end posts 30 and 32 includes a base support section 42 or 44 and a substantially vertical section generally referred to through this specification as a vertical section 46 or 48, according to an embodiment. Base support sections 42 and 44 define a base for supporting display structure 10 on a floor or other suitable supporting surface. In an embodiment, base support sections 42 and 44 include corresponding horizontal bars 50 and 52 and support legs 54, 56, 58, and 60. Horizontal bars 50 and 52 are substantially equal in length and configuration and are substantially horizontally oriented. Support legs 54, 56, 58, and 60 are configured to elevate vertical sections 46 and 48 off a floor or other suitable supporting surface to provide additional height to display structure 10. Support legs 54 and 56 extend from respective ends of horizontal bar 50, and support legs 58 and 60 extend from respective ends of horizontal bar 52. Support legs 54 and 56 and horizontal bar 50 are formed from a single piece of material, and support legs 58 and 60 and horizontal bar 52 are formed from a single piece of material, in an embodiment. In another embodiment, support legs 54 and 56 and support legs 58 and 60 are separately formed from horizontal bars 50 and 52. For example, support legs 54 and 56 and/or support legs 58 and 60 are formed from wood, and horizontal bars 50 and 52 are formed from metal.

In one embodiment, display structure 10 includes support bars 38 and 40 to provide additional stability to display structure 10 and in one instance, connector legs 62, 64, 66, and 68 serve to facilitate coupling of support bars 38 and 40 to end posts 30 and 32. Connector legs 62 and 64 extend substantially orthogonally relative to horizontal bar 50 and corresponding support legs 54 and 56, and connector legs 66 and 68 extend substantially orthogonally relative to horizontal bar 52 and corresponding support legs 58 and 60. Connector legs 62, 64, 66, and 68 each include mating mechanisms for mating with corresponding ends of support bars 38 and 40 to secure support bar 38 between connector legs 62 and 66 and support bar 40 between connector legs 64 and 68. For example, the mating mechanisms comprise extensions (not shown) and openings, where the extensions protrude from one or both of connector legs 62 and 66, one or both of connector legs 62 and 68, or support bars 38 and 40. The openings for receiving the protrusions are formed on the other of the connector legs 62 and 66, connector legs 64 and 68, or support bars 38 and 40. When the mating mechanisms are mated with each other, fasteners (e.g., fasteners 70) can be inserted through openings (e.g., threaded openings 71) formed on one or both of connector legs 62, 64, 66, and 68 or support bars 38 and 40. Although connector legs 62, 64, 66, and 68 and support bars 38 and 40 form a substantially rectangular base, fewer or more legs and/or support bars are included in other embodiments to define another shape of the base.

Vertical sections 46 and 48 are substantially equal in length and are configured to be substantially identical to each other. In one embodiment, to maintain one or more of boards 18, 20, and 22 between vertical sections 46 and 48, vertical section 46 extends substantially perpendicularly relative to horizontal bar 50 from a position that is substantially similar to a position on horizontal bar 52 directly adjacent vertical section 48. In one example, vertical section 46 extends from a position equidistant from ends of horizontal bar 50, and similarly, vertical section 48 extends from a position on horizontal bar 52 that is equidistant from the ends thereof. Alternatively, vertical section 46 is disposed closer to one end of horizontal bar 50 than another end, and vertical section 48 is disposed at a substantially similar position on horizontal bar 52.

Figure 7:
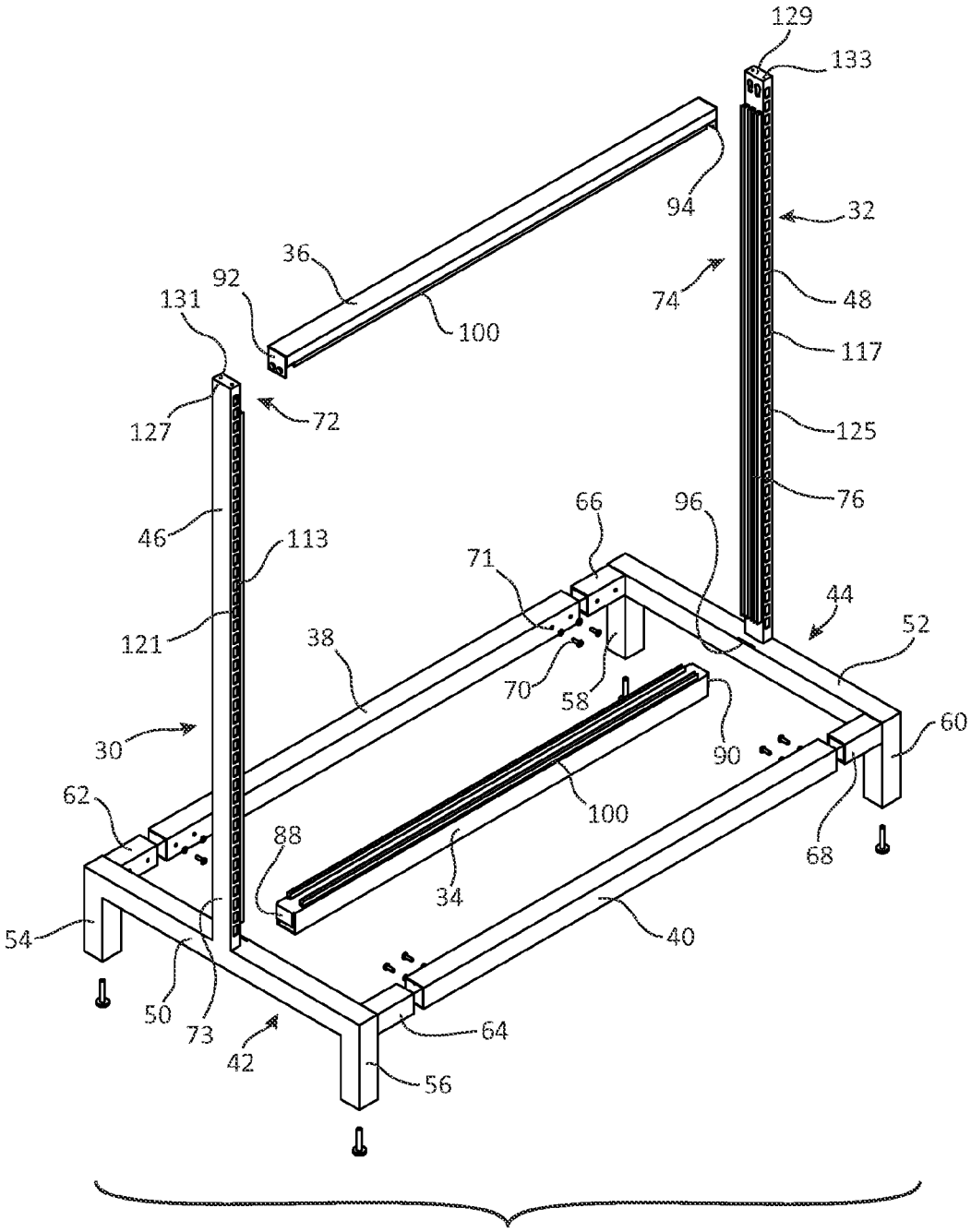
FIG. 7 is an exploded view illustration of the vertical display unit of FIG. 5, according to one embodiment of the present invention.
Figure 8:
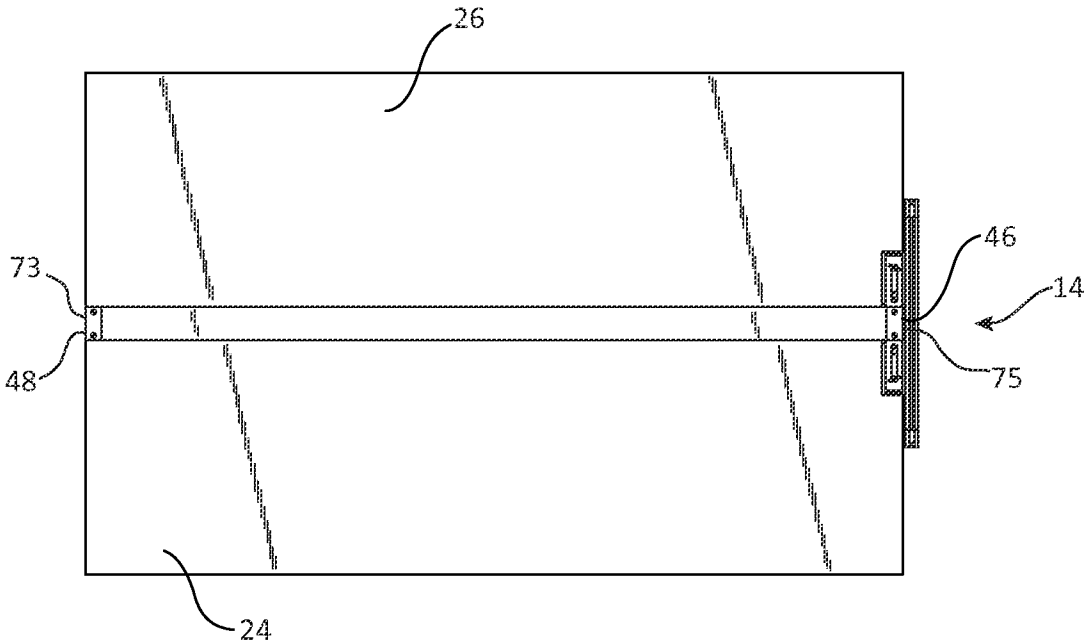
FIG. 8 is a top view of the display structure of FIG. 1, according to one embodiment of the present invention.

With additional reference to FIGS. 7 and 8, vertical sections 46 and 48 have interior-facing surfaces 72 and 74 and exterior-facing surface 73 and 75. Interior-facing surfaces 72 and 74 each includes one or more tracks 76. Each of tracks 76 is elongated and suitably configured for maintaining at least a portion of a side edge of one or more of boards 18, 20, and 22. In an embodiment, vertical sections 46 and 48 each include three tracks 76, respectively. Tracks 76 of each vertical section 46 and 48 extend along substantially an entire length of the corresponding vertical section 46 or 48, in an embodiment. In another embodiment, one or more of tracks 76 is comprised of sections that are staggered along the lengths of vertical sections 46 and/or 48. The one or more tracks 76 are grooves formed in interior-facing surfaces 72 and/or 74, in one example. Alternatively, walls extending from interior-facing surfaces 72 and/or 74 define tracks 76. Although vertical sections 46 and 48 are primarily described as including three substantially parallel tracks 76 each, other embodiments of vertical sections 46 and 48 may include fewer or more tracks. A total number of tracks on each of vertical sections 46 and 48 depends on a desired number of boards (e.g., boards 18, 20, and 22) to be disposed therebetween at one time.

Figure 6:
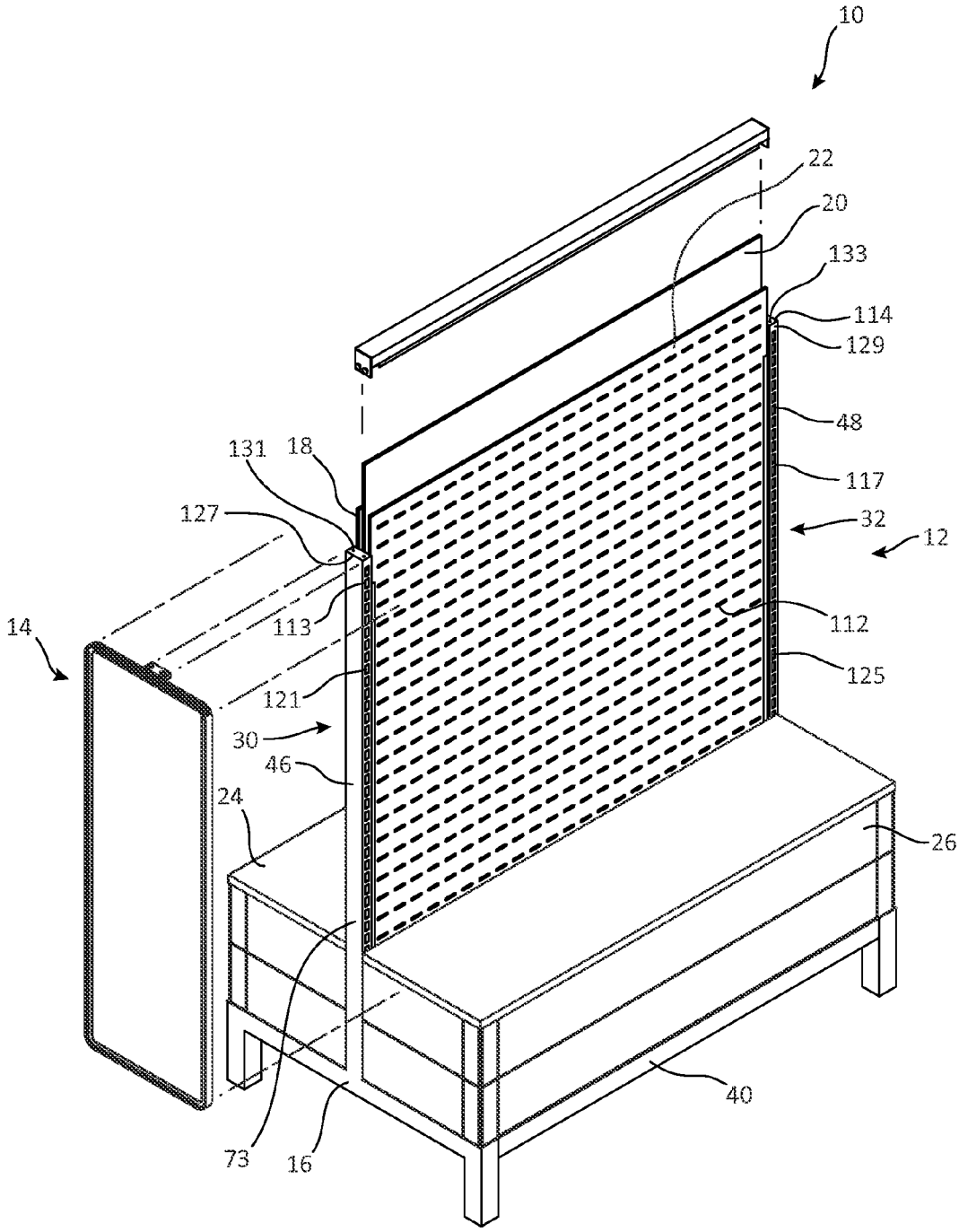
FIG. 6 is a partially exploded, perspective view illustration of the display structure of FIG. 1, according to one embodiment of the present invention.

Referring to FIGS. 6 and 7, to maintain the one or more boards 18, 20, and 22 at desired vertical positions, substantially horizontal beams 34 and 36 extend between vertical sections 46 and 48. In one embodiment, horizontal support 34 is a bottom horizontal support and extends substantially horizontally between bottom ends of vertical sections 46 and 48, and horizontal support 36 is a top horizontal support and extends substantially horizontally between top ends of vertical sections 46 and 48. Substantially horizontal beams 34 and 36 are fastened to vertical sections 46 and 48 by fastening mechanisms 88, 90, 92, and 94, in an embodiment. For example, fastening mechanisms 88 and 90 for horizontal support 34 comprise protrusions extending from respective ends of horizontal support 34 that are inserted into slits 96 (slit on vertical section 46 not shown). In another example, fastening mechanisms 92 and 94 comprise fasteners (e.g., screws, bolts, and the like) that are inserted through openings formed on respective ends of horizontal support 36 and openings formed on vertical sections 46 and 48. Although fastening mechanisms 88 and 90 and fastening mechanisms 92 and 94 are illustrated as having different configurations, both can have similar configurations in other embodiments.

Each of substantially horizontal beams 34 and 36 includes one or more tracks 100 (only one track 100 of horizontal support 36 is visible) with each track 100 being configured to retain a bottom or topside edge of one or more boards 18, 20, and 22. Each of the one or more tracks 100 is an elongated groove formed in a corresponding one of substantially horizontal beams 34 and 36, in an embodiment. In another embodiment, one or more tracks 100 are formed between walls that extend from one of substantially horizontal beams 34 and 36 a distance sufficient for retaining edges of one or more boards 18, 20, and 22. In an embodiment, three substantially parallel tracks 100 are included on horizontal support 34, and three substantially parallel tracks 100 (only one track 100 of horizontal support 36 is visible) are included on horizontal support 36. More or fewer tracks are included on one or both of substantially horizontal beams 34 and 36, depending on, for example, a total number of boards (e.g., boards 18, 20, and 22) to be held in position.

One or more of tracks 100 extends substantially along an entire length of the corresponding horizontal support 34 or 36, in an embodiment. In accordance with another embodiment, one or more of tracks 100 comprises track sections that are staggered along a length of the corresponding horizontal support 34 or 36. The track sections are uniform or non-uniform in length.

With reference to FIGS. 5-8, support boards 18, 20, and 22 are configured to provide a surface for hanging product and/or to provide an aesthetically pleasing appearance for display structure 10. In an embodiment, three support boards 18, 20, and 22 are included as part of display structure 10 and are made up of two outer boards or slotted boards 18 and 22 and an intermediate board 20 disposed therebetween.

Figure 23:
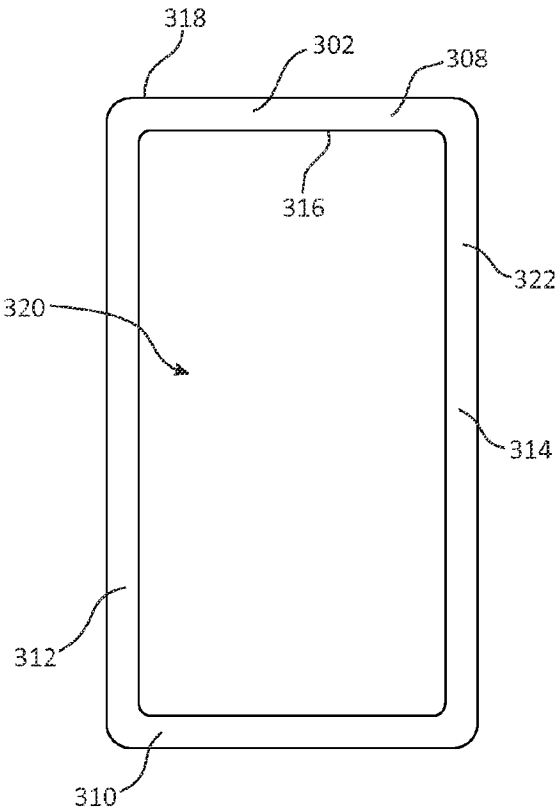
FIG. 23 is a front view of a front frame, according to one embodiment of the present invention.

Support boards 18, 20, and 22 have substantially similar dimensions. According to one embodiment, outer board 18 includes a plurality of rows of slots 112 and a peripheral edge portion or outer periphery 114 without slots. Each row includes an array of slots 112 arranged end to end with each other. Although each slot 112 has an elongated rectangular shape in the illustrations, slots 112 have different configurations, such as round, ovular, or the like, in other embodiments. Additionally, although slots 112 are arranged in rows in the Figures, other embodiments include slots arranged in concentric circles or other patterns. In still other embodiments, the slots 112 are dispersed on outer board 18. Outer board 18 is formed from a material having suitable structural integrity for suspending attachments and/or product 13 (FIG. 23) therefrom, such as an acrylic material, plastic, wood, metal, and the like. Although not shown, in one embodiment, outer board 22 is formed substantially similar to outer board 18, and thus, also includes slots 112 and peripheral edge portion 114 without slots.

To improve the appearance of display structure 10, in one embodiment, intermediate board 20 is configured to prevent light from shining through slots 112 of outer board 18 onto outer board 22. Intermediate board 20 is a solid panel without openings, in an embodiment. In another embodiment in which support boards 18, 20, and 22 are not intended to be used for product display, one or both of outer boards 18 and 22 comprises a solid panel, and/or one or more of support boards 18, 20, and 22 is omitted. In one example, all of support boards 18, 20, and 22 are omitted.

Figure 26:
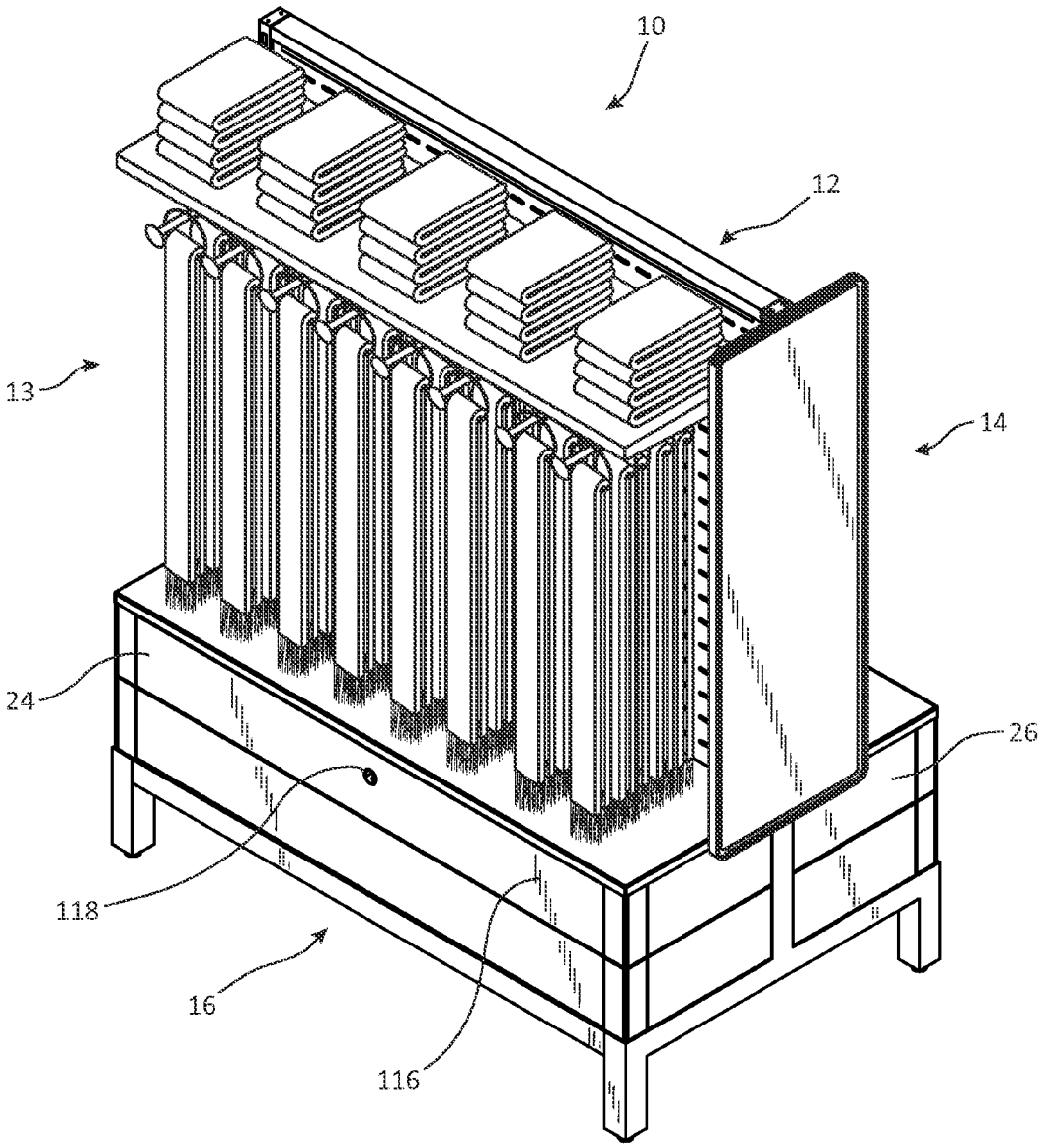
FIG. 26 is a front, perspective view illustration of the vertical display structure of FIG. 1 including a plurality of products hung from the vertical display structure.

With additional reference to FIG. 26, in one embodiment, display structure 10 includes bunkers 24 and 26 to provide a storage area for product 13 and/or to provide an additional surface for displaying product 13. Bunkers 24 and 26 are disposed on support frame 16. In an embodiment, bunker or front bunker 24 is disposed on a first or front half of support frame 16, bunker or back bunker 26 is disposed on a second or back half of support frame 16, and bunkers 24 and 26 are separated from each other by boards 18, 20, and 22. Front bunker 24 may include one or more pull out drawers 116. Pull out drawer 116 includes a locking mechanism 118 for securing product within drawer 116. Although not shown, back bunker 26 includes a pull out drawer in another embodiment. In alternate embodiments, one or both bunkers 24 or 26 are omitted.

Returning to FIGS. 1-8, end frame assembly 14 is coupled to support frame 12. Although end frame assembly 14 is shown as being coupled to vertical section 46, end frame assembly 14 is alternatively or additionally coupled to vertical section 48. In this regard, vertical section 46 includes opposing vertically extending side surfaces 111 and 113 (facing the same direction as, that is, extending substantially parallel to, the major faces of boards 18 and 22) that include arrays of slits or openings 119 and 121, respectively. As illustrated, slits 119 and 121 are rectangular and arranged end to end or side by side. In another embodiment, slits 119 and/or 121 are circular, ovular, or another shape. Vertical section 48 includes opposing vertically extending side surfaces 115 and 117 (facing in the same direction as, that is, extending substantially parallel to, the major faces of boards 18 and 22) that include arrays of slits or openings 123 and 125, respectively. Vertically extending side surfaces 115 and 117 and array of slits 123 and 125 are substantially identical to vertically extending side surface 11 and 113 and arrays of slits 119 and 121, respectively.

In one example, each of vertical sections 46 and 48 includes a top end 127 and 129, respectively, each including fastener openings 131 and 133 formed therethrough. Top ends 127 and 129 extend substantially perpendicularly to vertically extending side surfaces 111 and 113 and 115 and 117, respectively. Although two fastener openings 131 and 133 are shown on each top end 127 and 129, more or fewer alternatively are included.

Turning to FIGS. 9-12, end frame assembly 14 includes a vertically oriented frame or frame section 120, an upper connection member or top coupling mechanism 122, a lower connector assembly 124, and a display panel 126. Frame section 120 forms a closed-loop frame shape that, in one embodiment, includes a top segment or wall 128, a bottom segment or wall 130 (otherwise referred to as a lower support member of frame section 120), and first and second side segments or walls 132 and 134 extending between the top and bottom walls 128 and 130. Frame section 120 is formed from a single unitary component, or each of walls 128, 130, 132, and 134 are formed separately and coupled together. Although, as illustrated, walls 128, 130, 132, and 134 collectively define a substantially rectangular shape, other configurations are contemplated alternatively. Frame section 120 comprises metal, wood, acrylic, plastic, or another material suitable for maintaining structural integrity to withstand wear and tear.

Walls 128, 130, 132, and 134 are configured to maintain display panel 126 in frame section 120. For example, bottom and sidewalls 130, 132, and 134 include tracks 140, 142, and 144 (FIG. 12) configured to retain edges of display panel 126. Tracks 140, 142, and 144 are each a channel or a groove formed in corresponding ones of walls 130, 132, and 134. Tracks 140, 142, and 144 are formed between walls that extend a distance from one of bottom and sidewalls 130, 132, and 134 sufficient for retaining edges of display panel 126, which is substantially planar. More or fewer tracks are included on one or more of walls 130, 132, and 134, depending on a total number of panels (e.g., display panels 126 or other panels) to be held in position.

One or more of tracks 140, 142, and 144 extends substantially an entire length of corresponding walls 130, 132, and 134. Alternatively, one or more of tracks 140, 142, and 144 comprises track sections that are staggered along a length of the corresponding walls 130, 132, and 134. The track sections 142 and 144 of walls 132 and 134 are uniform or non-uniform in length.

To retain display panel 126 along a top edge thereof, top wall 128 has a longitudinal slot 146 extending along a majority of its length. In an embodiment, longitudinal slot 146 has a length and width that is slightly larger than a width and thickness of display panel 126 so that display panel 126 can be inserted through longitudinal slot 146 to tracks 142 and 146 during assembly of end frame assembly 14. Although portions of top wall 128 adjacent sidewalls 132 and 134 (i.e., corners) are curved and longitudinal slot 146 extends long the curved portions of top wall 128, corners are blunt in alternative embodiments.

Figure 13:
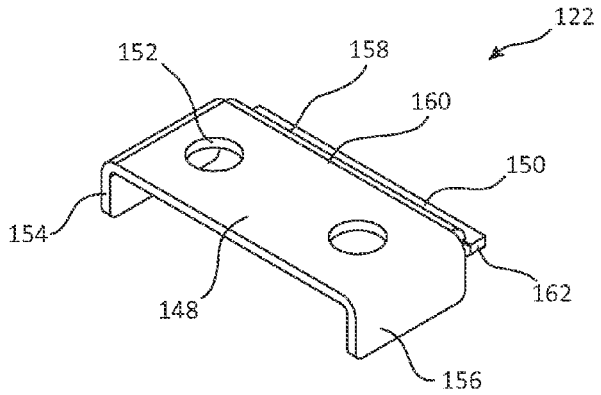
FIG. 13 is a perspective view illustration of an upper connection member, according to one embodiment of the present invention.

Upper connection member 122 couples top wall 128 to top end 127 (or 129 in other embodiments) of vertical support 46 (or 48 in other embodiments). With additional reference to FIG. 13, in an embodiment, upper connection member 122 includes a primary or horizontal plate 148 having an attachment flange 150, apertures 152, and side overhangs 154 and 156. Horizontal plate 148 is substantially rectangular and is slightly larger in dimension than corresponding top end 127 or 129 of vertical support 46 or 48. Alternatively, horizontal plate 148 is ovular, circular, or has a polygonal or other shape having a width, length, or diameter that is greater than at least one width, length, or diameter of top end 127 or 129 of vertical support 46 or 48. Apertures 152 are formed through horizontal plate 148. In an embodiment, two apertures 152 are included on horizontal plate 148 at locations that can be aligned with fastener openings 131 or 133 on top end 127 or 129 of vertical support 46 or 48, when horizontal plate 148 is disposed over top end 127 or 129. In another example, more or fewer apertures 152 are included on horizontal plate 148.

Attachment flange 150 couples upper connection member 122 to vertical frame section 120 and has a curved section 158 that extends along and initiates at a longitudinal edge 160 of horizontal plate 148 to attach a rear projection 162 thereto. Rear projection 162 is lower than horizontal plate 148 and is configured to be sufficiently wide for welding to top wall 128 or otherwise coupling thereto. In another embodiment, attachment flange 150 is planar and omits curved section 158.

Side overhangs 154 and 156 extend from lateral side edges of horizontal plate 148 substantially orthogonal to rear projection 162. In an embodiment, side overhangs 154 and 156 are suitably spaced apart such that top end 127 or 129 of vertical support 46 or 48 fits snugly therebetween. For example, top end 127 or 129 is friction fit between side overhangs 154 and 156. To insure that horizontal plate 148 is fixedly attached to vertical section 46, fasteners 138 (FIG. 12) are inserted into apertures 152 and corresponding fastener openings 131 or 133 to couple horizontal plate 148 to top end 127 or 129, in the illustrated embodiments.

In another embodiment of upper connection member 122, horizontal plate 148 is replaced with a spring plate that is contracted and inserted into a cavity (not shown) formed in top end 127 or 129 of vertical support. Alternatively, upper connection member 122 includes a different coupling mechanism for attaching to top end 127 or 129 of vertical support 46 or 48.

Figure 11:
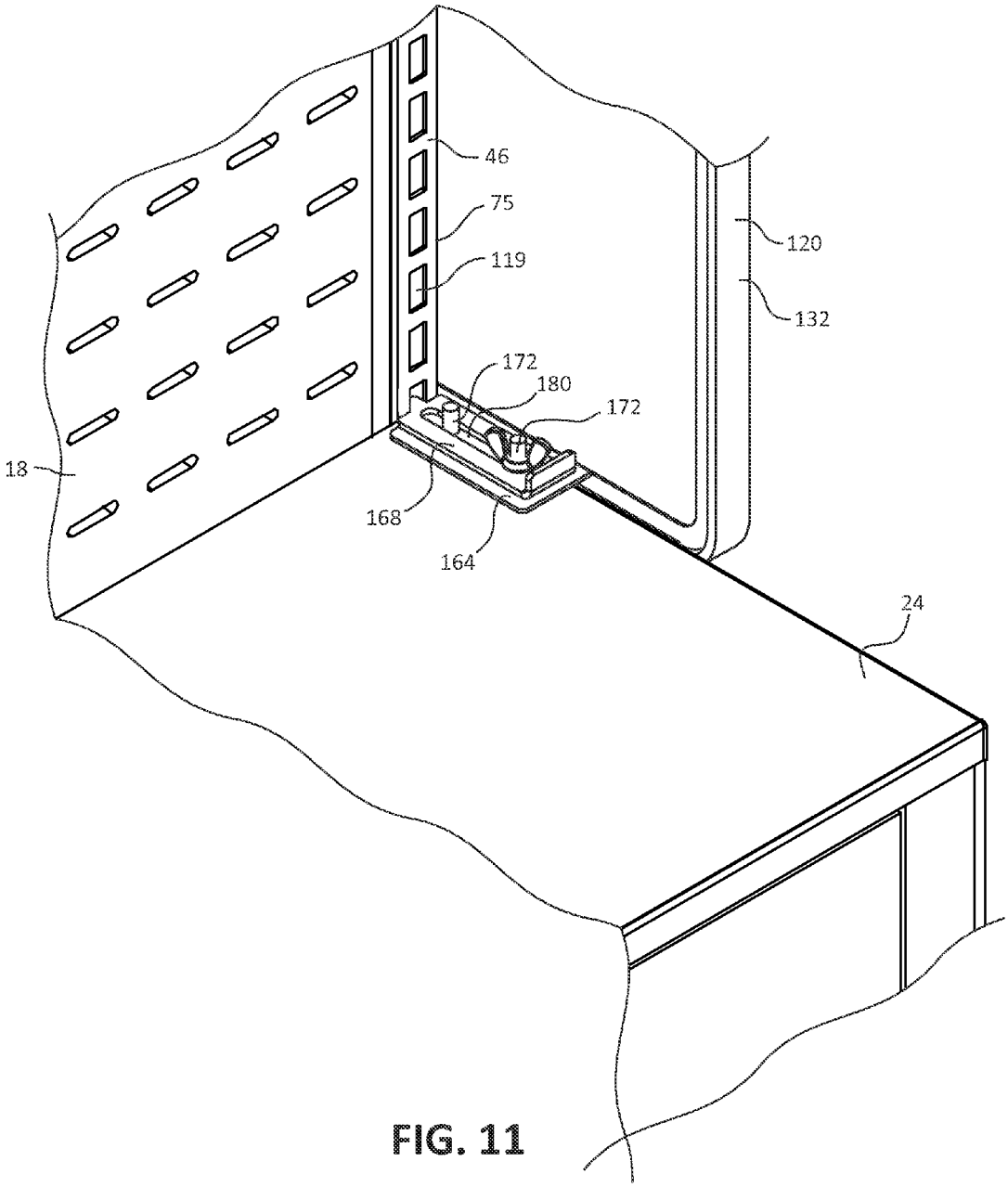
FIG. 11 is a close up, perspective view of a portion of a lower connector assembly coupled to an end frame assembly, according to an embodiment.
Figure 14:
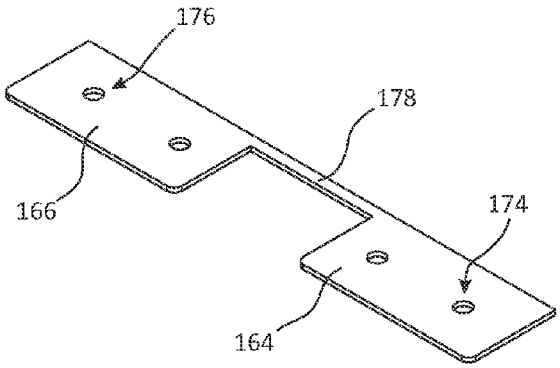
FIG. 14 is a perspective view illustration of a stationary plate of a lower connection mechanism, according to one embodiment of the present invention.
Figure 15:
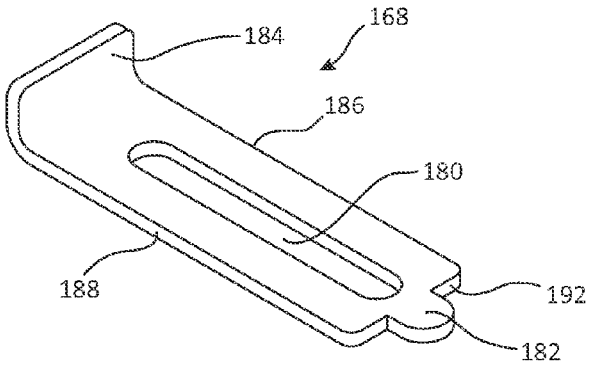
FIG. 15 is a perspective view illustration of a slide plate of a lower connection mechanism, according to one embodiment of the present invention.

Referring to FIGS. 11, 14, and 15, lower connection assembly 124 includes two horizontal or stationary plates 164 and 166, two slide plates 168 and 170, and fasteners 172. Stationary plates 164 and 166 extend from bottom wall 130 of frame section 120 and are spaced a sufficient distance apart such that each plate 164 and 166 can be disposed on opposite sides of vertical section 46. In an embodiment, the distance between stationary plates 164 and 166 forms a gap or opening between plates 164 and 166 and is substantially equal to a distance between side surfaces 111 and 113 of vertical section 46 or side surfaces 115 and 117 of vertical section 48. With additional reference to FIG. 14, each stationary plate 164 and 166 is substantially rectangular. Although illustrated in the Figures as having a longer length than width and being substantially similar in dimensions, stationary plates 164 and/or 166 have different configurations in other embodiments. Fastener openings 174 and 176 are formed through each stationary plate 164 and 166. In an embodiment, each stationary plate 164 and 166 has more than one fastener opening 174 and 176, e.g., two fastener openings. Thread or smooth walls define fastener openings 174 and 176. In accordance with an embodiment, stationary plates 164 and 166 form a horizontal connection member including a connector piece 178 that connects two corners of plates 164 and 166. In another embodiment, stationary plates 164 and 166 are entirely separate pieces. Although stationary plates 164 and 166 are shown as being substantially planar, they may be curved or otherwise non-planar in other embodiments.

Figure 10:
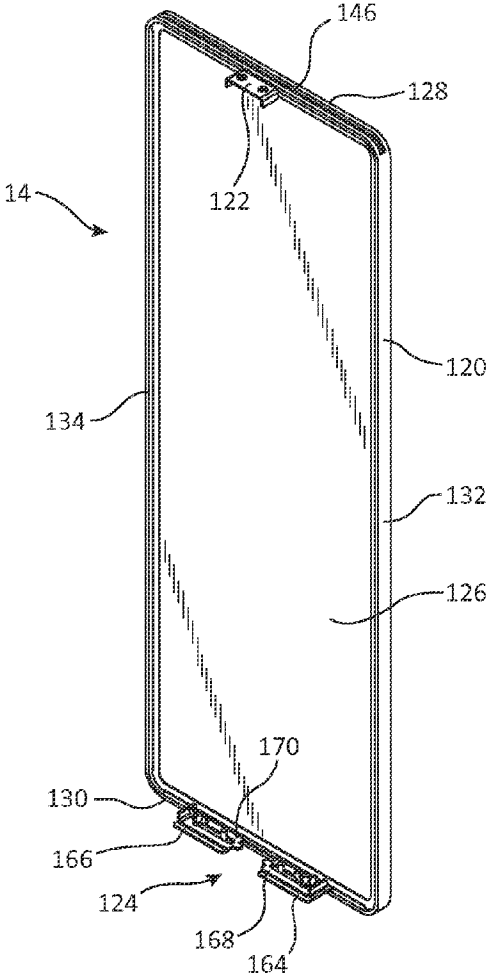
FIG. 10 is a rear, perspective view illustration of an end frame assembly, according to one embodiment of the present invention.
Figure 9:
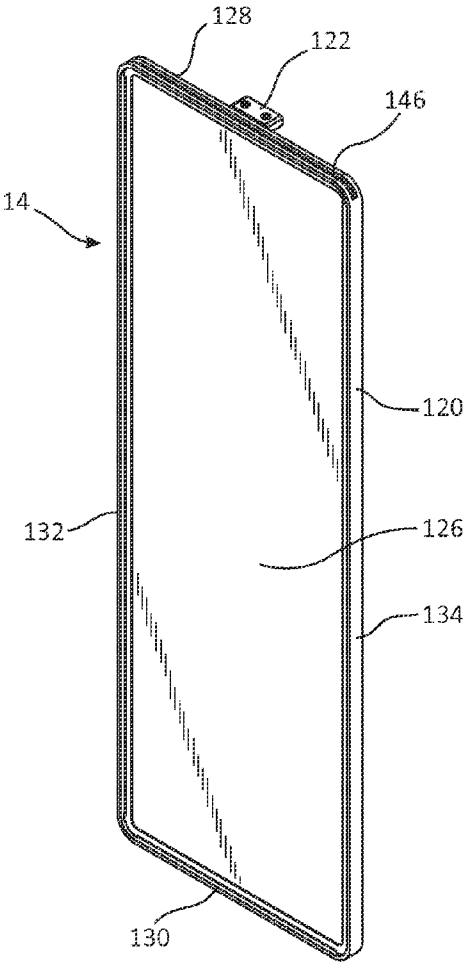
FIG. 9 is a front, perspective view illustration of an end frame assembly, according to one embodiment of the present invention.
Figure 12:
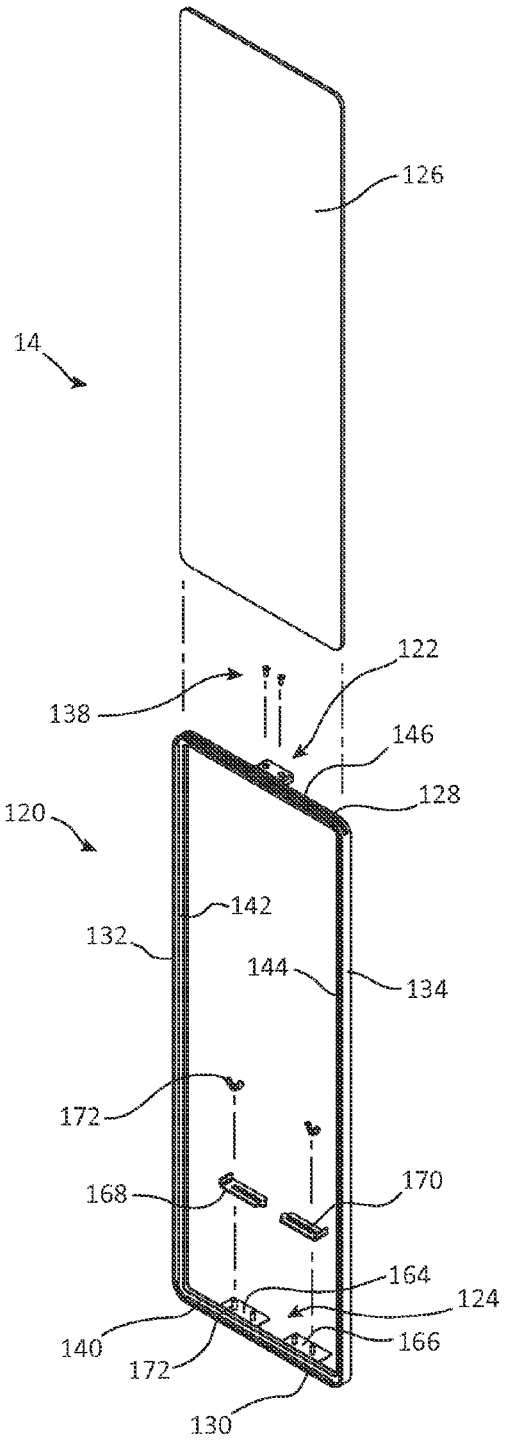
FIG. 12 is an exploded, perspective view illustration of the end frame assembly of FIG. 9, according to one embodiment of the present invention.

As shown in FIGS. 10-12, slide plates 168 and 170 are disposed over stationary plates 164 and 166. Slide plates 168 and 170 are configured substantially similarly to each other. For simplicity, reference to slide plate 168 will be used for description, however it will be understood that slide plate 170 includes substantially identical features. With additional reference to FIG. 15, slide plate 168 is substantially rectangular and includes a slot 180, a tab 182, and a curved flange 184. In other embodiments, slide plate 168 is ovular or another shape that is suitable for covering at least a portion of stationary plate 164 or 166 that includes fastening opening 174 or 176.

Slot 180 extends longitudinally substantially along a mid-section of slide plate 168. In an embodiment in which stationary plate 164 or 166 includes two spaced apart fastener openings 174 or 176, slot 180 extends along a portion of the length of slide plate 168 that is at least as long as a distance between furthest edges of fastener openings 174 or 176. Additionally or alternatively, slot 180 extends substantially an entire length of slide plate 168. Although shown as being formed substantially halfway between both longitudinal edges 186 and 188 of slide plate 168, slot 180 is formed closer to one edge 186 or 188 than to the other in other alternatives. Slot 180 has tapered ends, in an embodiment, to more easily receive one or more fasteners 172 (FIG. 12) for coupling slide plate 168 to stationary plate 164 or 166. Fasteners 172 each comprise a screw, bolt, or another component capable of mating with a nut, wingnut, and the like, when inserted through slot 180 and fastener openings 174 or 176. Although two fasteners 172 each are shown for coupling slide plates 168 and 170 to stationary plates 164 and 166, other embodiments include more fasteners.

Tab 182 extends from a lateral edge 192 of slide plate 168. Tab 182 is configured to be inserted into one of slits 119, 121, 123, or 125 on side surfaces 111, 113, 115, and 117 of vertical section 46 and/or 48. In this regard, tab 182 has a width that is equal to or less than width of corresponding one of slits 119, 121, 123, or 125. Tab 182 is tapered, in an embodiment, having a curved edge to form a semicircle. In another embodiment, tab 182 is substantially trapezoidal and has two side edges that angle toward each other to terminate at an insertion edge. Alternatively, lateral edge 192 is tapered or tab 182 has a different shape that is suitable for insertion into a corresponding one of slits 119, 121, 123, or 125.

Curved flange 184 is located on an opposite end of slide plate 168 from tab 182 and curves upwardly to provide a grasping surface for a person interacting with slide plate 168 to linearly move slide plate 168 along a length of stationary plate 164 or 166. Curved flange 184 is disposed substantially perpendicularly relative to slide plate 168, or curved flange 184 is formed at a non-perpendicular angle relative to slide plate 168.

Figure 16:
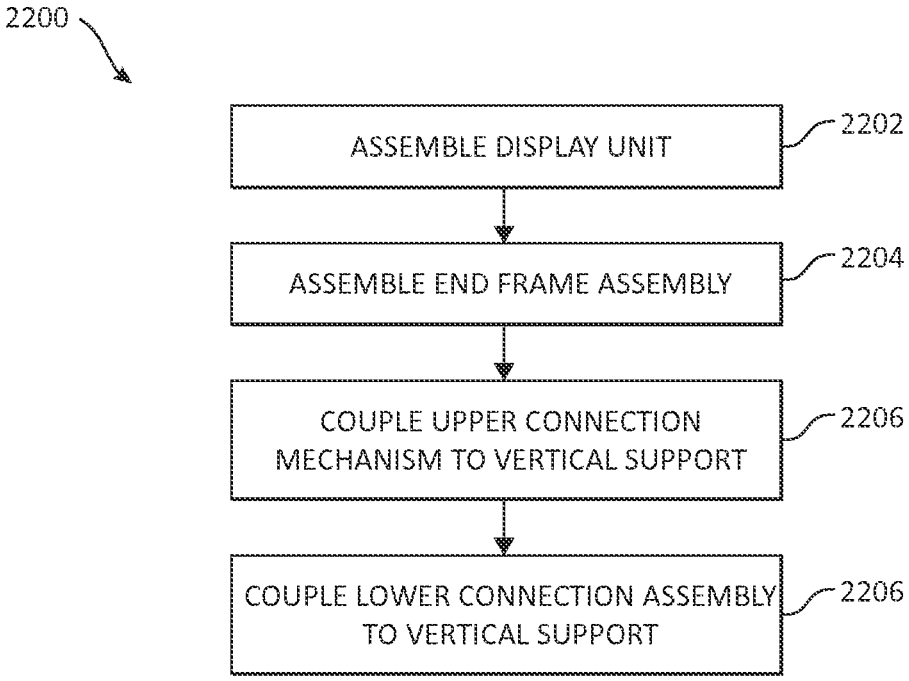
FIG. 16 is a flow diagram of a method of assembling a display structure, according to one embodiment of the present invention.

FIG. 16 illustrates a method 2200 of coupling end frame assembly 120 to display structure 10. With reference now to FIG. 7-15, vertical display unit 12 is assembled, at 2202, such that exterior-facing surface 73 of vertical section 46 and exterior-facing surface of vertical section 48 are exposed. Additionally, end frame assembly 14 is assembled, at 2204.

Upper connection member 122 is coupled to top end 127 of vertical support 46 or top end 129 of vertical support 48, at 2206. In an embodiment, upper connection member 122 is disposed over top end 127 or 129 and positioned such that side overhangs 154 and 156 snugly fit around top end 127 or 129. Apertures 152 of upper connection member 122 are aligned with fastener openings 131 or 133 and fasteners 138 are inserted through the openings to fasten upper connection member 122 to vertical support 46 or 48.

Then, at 2208, lower connection assembly 124 is then coupled to one of vertical supports 46 and 48. Stationary plates 164 and 166 are positioned on opposite sides of vertical support 46 or 48 (whichever vertical support 46 or 48 to which upper connection member 122 is coupled). Slide plates 168 and 170 are disposed over corresponding stationary plates 164 and 166, respectively, and positioned such that tabs 182 extend toward corresponding vertical support 46 or 48 and slots 180 are disposed over fastener openings 174 or 176 of corresponding stationary plates 164 and 166. Each slide plate 168 and 170 is adjusted such that tabs 182 are inserted into a slit (e.g., one of slits 119, 121, 123, or 125 of corresponding vertical support 46 or 48). For example, slide plate 168 is slid across stationary plate 164 toward the other stationary plate 166 until tab 182 of slide plate 168 engages with slit 119 of vertical support 46, and slide plate 170 is slide across stationary plate 166 until tab 182 toward the other stationary plate 168 until slide plate 170 engages with slit 121 of vertical support 46. Slide plates 168 and 170 are held in position by coupling fasteners 172 to slots 180 and fastener openings 174 and 176. In one embodiment, fasteners 172 couple slide plates 168 and 170 to stationary plates 164 and 166, but are loosened to allow slide plates 168 and 170 to move relative to stationary plates 164 and 166 and to allow easy removal of end frame assembly 14 from display structure 10. In an embodiment including one or more bunkers 24 or 26, stationary plate 164 or 166 rests on a top surface of corresponding bunker 24 or 26 to provide stability for frame assembly 14. In an embodiment in which one or both of bunkers 24 and/or 26 are omitted, stationary plates 164 and/or 166 rest on a top surface of corresponding substantially horizontal beams 50 and/or 52 or other suitable horizontal member to provide additional rotational stability to display unit 12.

Figure 17:
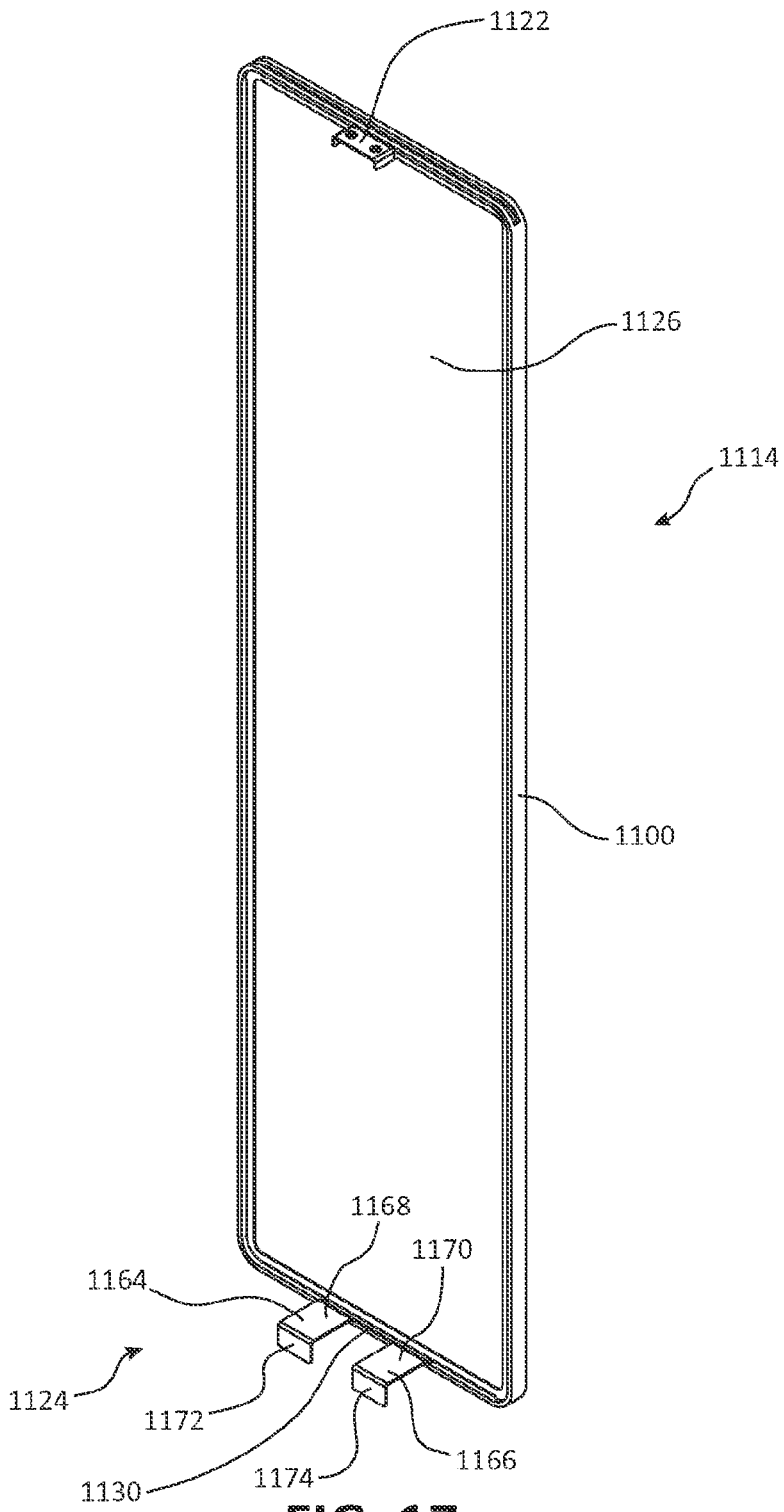
FIG. 17 is a rear perspective view of an end frame assembly, according to one embodiment of the present invention.
Figure 18:
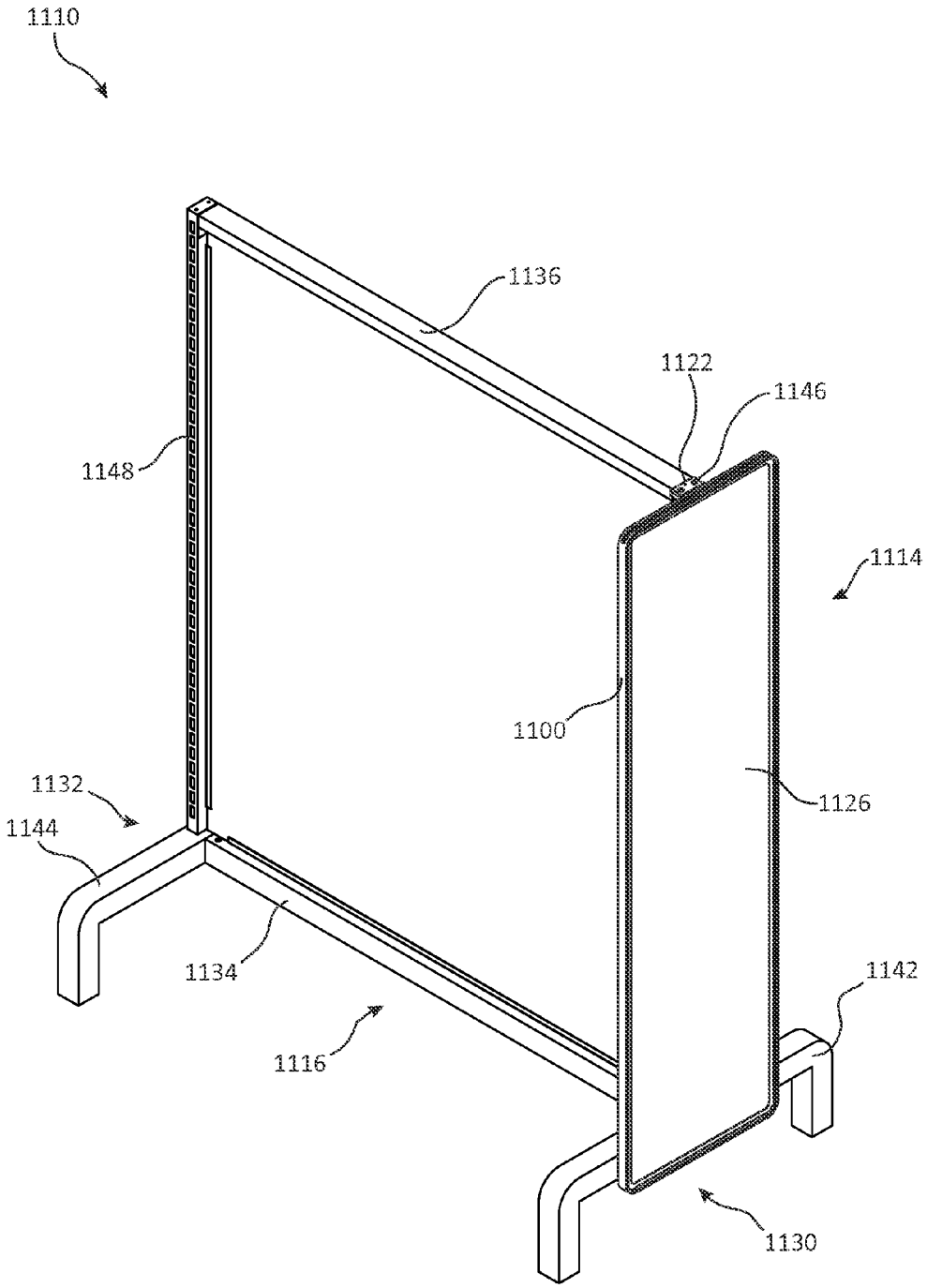
FIG. 18 is a front, perspective view of a vertical display unit, according to one embodiment of the present invention.

FIGS. 17 and 18 illustrate an end frame assembly 1114 including a lower connection assembly 1124 configured according to another embodiment. End frame assembly 1114 includes a vertical frame section 1100, an upper connection member 1122, and a display panel 1126 that are substantially similar in configuration to vertical frame section 100, upper connection member 122, and display panel 126 except vertical frame section 1110 and display panel 1126 are longer than vertical frame section 100 and display panel 126. Lower connection assembly 1124 comprises two stationary plates 1164 and 1166. Stationary plates 1164 and 1166 include horizontal portions 1168 and 1170, respectively, each extending from a bottom wall 1130 of vertical frame section 1100 and a vertical portions 1172 and 1174, respectively, each extending substantially perpendicularly from edges corresponding horizontal portions 1168 and 1170 to form L-shaped pieces.

End frame assembly 1114, and in particular, stationary plates 1164 and 1166, are attached to a display structure 1110 that omits bunkers. For example, display structure 1110 includes a support frame 1116 comprised of components including a pair of end posts or vertically extending supports 1130 and 1132 and a pair of substantially horizontal beams or horizontally extending supports 1134 and 1136. Substantially horizontal beams 1134 and 1136 are formed substantially similar to substantially horizontal beams 34 and 36 described above. End posts 1130 and 1132 are configured substantially similarly to end posts 30 and 32 and include vertical sections 1146 and 1148 and base sections 1142 and 1144 that are substantially similar to vertical sections 46 and 48 and base sections 42 and 44, except that, in one embodiment, base sections 1142 and 1144 do not include connector legs. Lower connection assembly 1114 is hooked onto base section 1142 or 1144.

Figure 20:
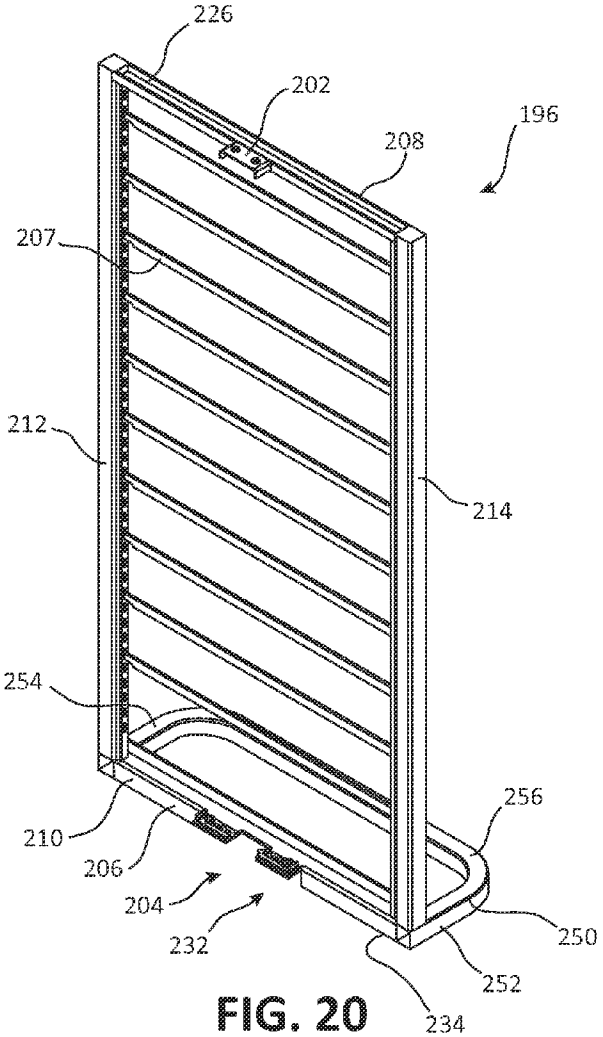
FIG. 20 is a rear, perspective view of an end frame assembly, according to one embodiment of the present invention.
Figure 19:
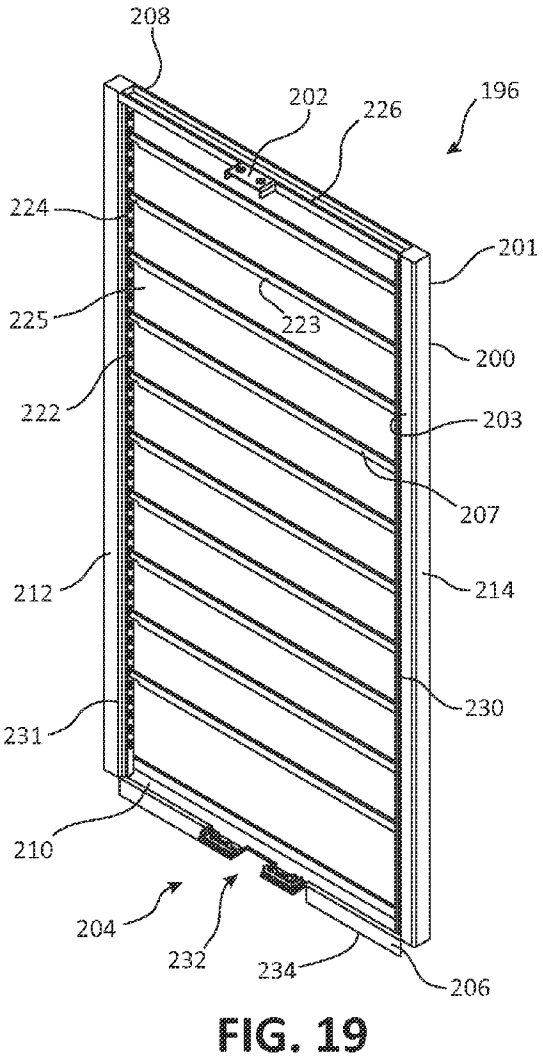
FIG. 19 is a rear, perspective view of an end frame assembly, according to one embodiment of the present invention.
Figure 21:
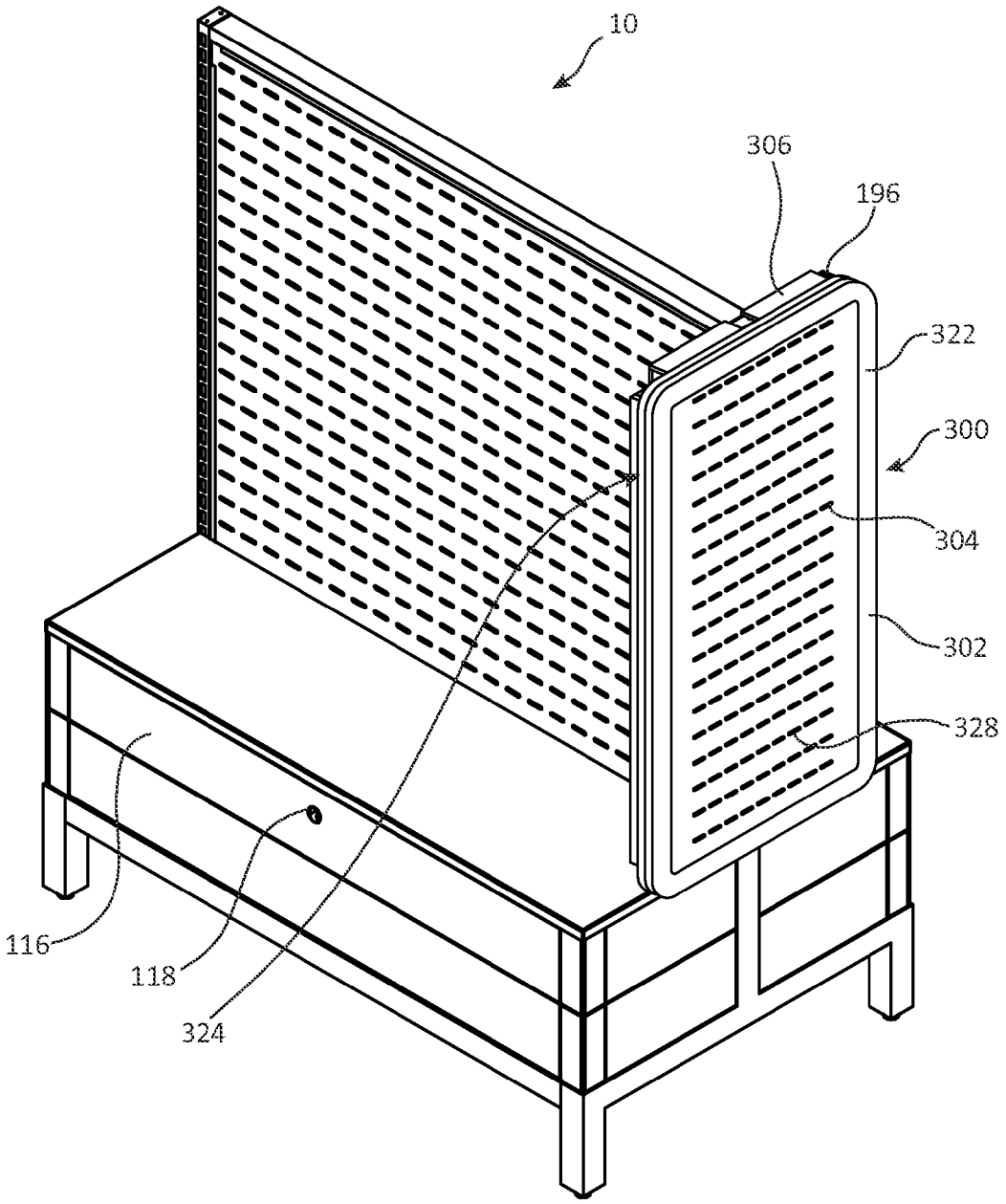
FIG. 21 is a front, perspective view illustration of the vertical display unit coupled to a supplemental side frame assembly, according to one embodiment of the present invention.
Figure 22:
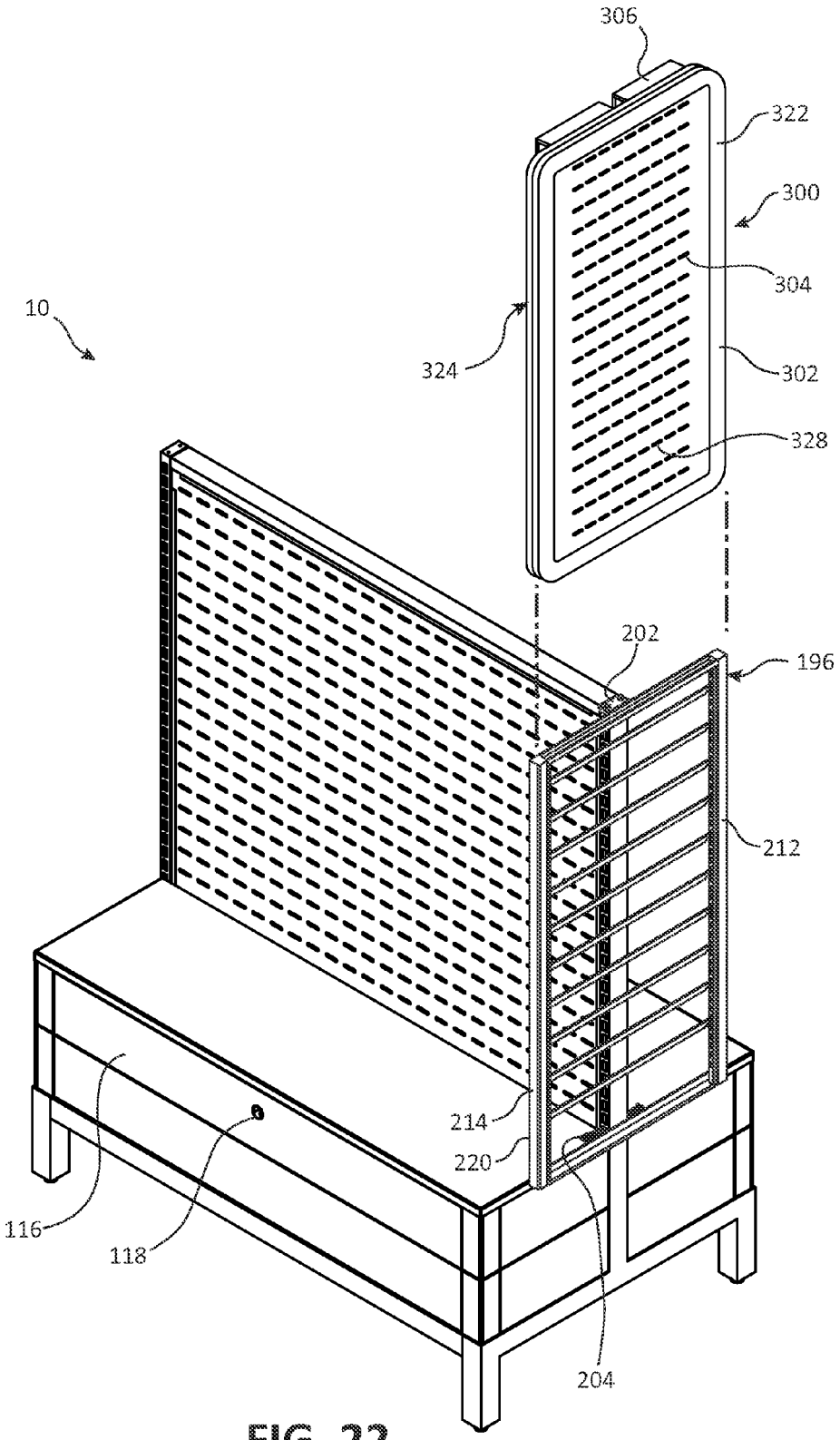
FIG. 22 is a partially exploded, perspective view of the vertical display unit coupled to a supplemental side frame assembly of FIG. 21, according to one embodiment of the present invention
Figure 25:
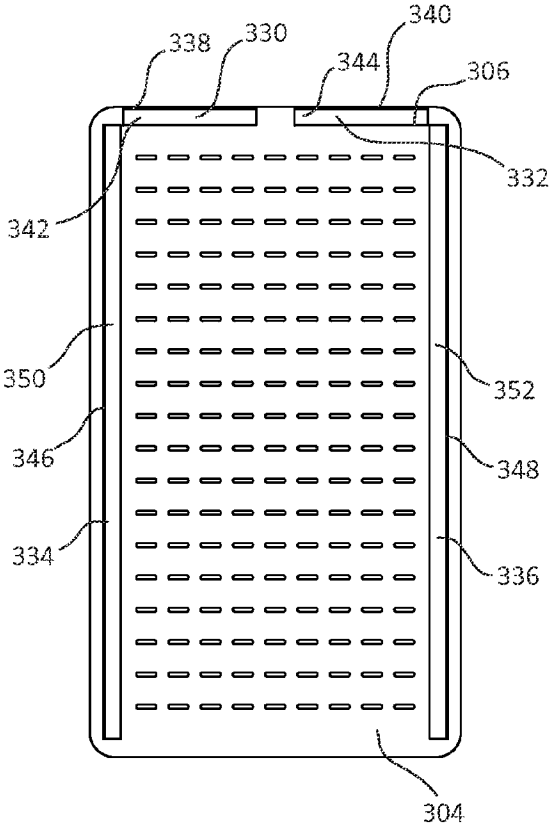
FIG. 25 is a rear view of a back frame, according to one embodiment of the present invention.
Figure 24:
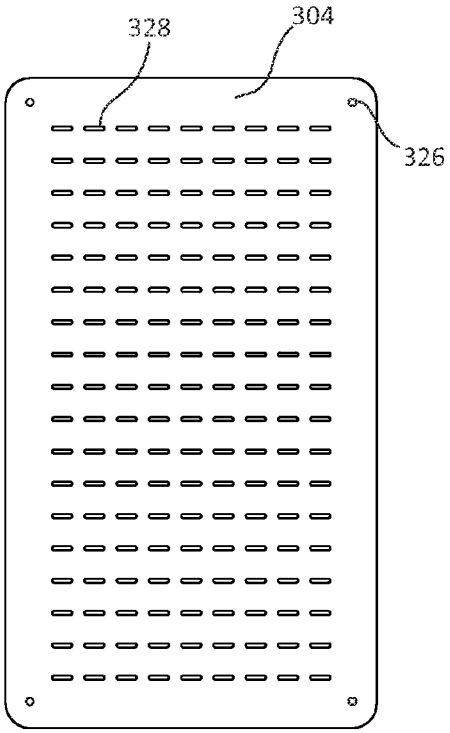
FIG. 24 is a front view of an intermediate panel, according to one embodiment of the present invention.

FIGS. 19 and 20 illustrate an end frame assembly 196 for mounting to display structure 10 (in particular, vertical supports 30 and/or 32), according to another embodiment. End frame assembly 196 includes a vertically oriented frame section 200, an upper connection member 202, a lower connector assembly 204, a panel 206, and slats 207. In one embodiment, upper connection member 202 and lower connector assembly 204 are formed substantially similarly (e.g., identically) to upper connection member 122 and lower connector assembly 124, respectively.

In one example, frame section 200 has a front face 201 and a back face 203 and includes a top wall 208, bottom wall 210, and side or vertically extending walls 212 and 214 extending between top and bottom walls 208 and 210. In accordance with an embodiment, surfaces of top wall 208 and bottom wall 210 forming back face 203 are slightly inset from surfaces of sidewalls 212 and 214 that form back face 203.

Sidewalls 212 and 214 include slits 222 (shown only on sidewall 212) arranged in an array along interior-facing surfaces of sidewalls 212 and 214, in one embodiment of frame section 200. Slits 222 are rectangular and arranged end to end (as illustrated) or side by side. In another embodiment, slits 222 are circular, ovular, or another shape suitable for receiving an end of one of slats 207.

In one example, slats 207 extend across frame section 200 between sidewalls 212 and 214 and are vertically spaced from one another. Slats 207 are made of wood, metal, laminate, acrylic, or another material, and each includes a main body 223 having ends 224 that are inserted into a selected slit 222 in corresponding sidewall 212 or 214. Slats 207 are selectively and readily couplable and uncouplable from frame section 200 to vary their positioning relative to each other. In one embodiment, slats 207 have a thickness configured to selectively receive back hook structures on display cards supporting jewelry or similar items for retail sale. Other items offered for retail sale may be hung directly on one or more of slats 207.

Depending on the size and/or shape of slits 222, ends 224 of slats 207 can be tapered or have another configuration for easy insertion into slit 222. Slats 207 extend substantially parallel with top wall 208. Alternatively, to provide visual interest, slats 207 extend across frame section 200 in a non-parallel manner relative to top wall 208. Although ten total slats 207 are depicted in the FIGS. 19 and 20, more or fewer slats are included in other embodiments. In one embodiment, end frame assembly 196 does not include any slats 207, for example, when a slotted panel or other display structure is mounted on end frame assembly 196.

In one embodiment, panel 206 is positioned and continuously extends between back surfaces of top wall 208 and bottom wall 210 and exterior-facing surfaces of vertical section 46 or 48. Panel 206 also has longitudinal edges 230 and 231 that are disposed between sidewalls 212 and 214. In an embodiment, when end frame assembly 196 is coupled to vertical section 46 or 48, panel 206 is disposed between frame section 200 and vertical section 46 or 48. Additionally, front surface of panel 206 faces slats 207. In another embodiment, panel 206 extends downwardly from bottom wall 210, and portions of panel 206 described previously as extending between top wall 208 and bottom wall 210 are omitted. In one embodiment, to at least partially prevent panel 206 from falling vertically downward relative to bottom wall 210, panel 206 has a cutout 232 formed in its bottom lateral edge 234 to at least partially surround lower connection assembly 204. Panel 206 rests over and is supported by lower connection assembly 204, which prevents panel 206 from moving vertically. In an embodiment of display structure 10 in which bunkers 24 and 27 are included, portions of panel 206 on either side of cutout 232 rest against top surfaces of bunkers 24 and 27 to provide additional support and rotational stability to panel 206.

In one example, panel 206 is substantially transparent and/or translucent to allow a viewer to see vertical section 46 or 48 when end frame assembly 196 is hung therefrom. In another embodiment, panel 206 is substantially opaque. Panel 206 comprises wood, metal, particleboard, cardboard, and the like.

In another embodiment of end frame assembly 196, a horizontally oriented frame section 250 is included in addition to vertically oriented frame section 200, as illustrated in FIG. 20, to provide additional visual depth and/or interest to display structure 10 and, in one example, to provide a bumper to deflect consumers and their shopping carts from inadvertently contacting end frame assembly 106 or the retail items displayed thereon. Horizontally oriented frame section 250 extends substantially perpendicularly from sidewalls 212 and 214 to form a shelf. For example, horizontally oriented frame section 250 is substantially U-shaped and includes a first side arm 252 extending from sidewall 212, a second side arm 254 extending from sidewall 214, and an extension arm 256 extending side arm 252 to side arm 254.

In some instances, a retailer may choose to quickly change an appearance of display structure 10. Thus, rather than disassembling end frame assembly 196, retailer may choose to place a supplemental frame assembly 300 over end frame assembly 196. Turning now to FIGS. 21-26, supplemental frame assembly 300 includes a front frame 302, an intermediate panel 304, and a back frame 306.

Referring primarily to FIGS. 21-25, front frame 302 is configured to provide an aesthetically pleasing or finished appearance to supplemental frame assembly 300 and has a top wall 308, bottom wall 310, and two sidewalls 312 and 314 extending therebetween. The edges of the walls 308, 310, 312, and 314 define an interior frame edge 316 and an exterior frame edge 318. Interior frame edge 316 defines an opening 320 to provide access to display structures placed within front frame opening 320 or intermediate panel 304 when front frame 302 is placed thereover. Exterior frame edge 318 defines an outer perimeter that is shaped substantially similarly to the outer perimeter but sized larger than intermediate panel 304. Accordingly, in one example, front frame 302 and intermediate panel 304 have substantially coterminous perimeters. In an embodiment, front frame 302 has a substantially rectangular shape with curved corners. In other embodiments, front frame 302 has a different perimeter shape than intermediate panel 302.

Front frame 302 has a front or exposed face 322 and a back or non-exposed face 324. Front face 322 is substantially uniform in color and/or does not include designs imprinted or formed thereon, in an embodiment. Alternatively, front face 322 is used to draw attention to display structure 10 and is multi-colored, has a color that contrasts intermediate panel 304, and/or includes indicia imprinted thereon.

Front frame 302 attaches to fastener openings 326 on intermediate panel 304 via fingers (not shown) that extend from back face 324. In an embodiment, fingers mate and are friction fit with fastener openings 326 and/or are adhered to intermediate panel 304 after insertion into fastener openings 326. In other embodiments, front frame 302 and intermediate panel 304 are glued, ultrasonically welded, or otherwise adhered or coupled together.

Intermediate panel 304 is maintained between the front frame 302 and the end frame assembly 196 (or vertical section 46 or 48) and can be employed to display products on supplemental frame assembly 300. As noted above, intermediate panel 304 includes fastener openings 326, which are formed at locations which front frame 302 can cover. In addition to fastener openings 326, intermediate panel 304 includes a plurality of rows of slots 328. Slots 328 are employed to receive attachment components (not shown), which are used for hanging product and/or mirrors. Each row includes an array of slots 328 aligned horizontally end to end. In another embodiment, slots 328 are aligned vertically end to end. In still other embodiments, slots 308 are arranged in a different pattern, such as in concentric rings, or in a random pattern. Although slots 328 are illustrated as elongated openings, slots 328 are round or have other shapes in alternative embodiments. In another embodiment, intermediate panel 304 is a solid panel and omits slots.

Back frame 306 is configured to temporarily couple supplemental side frame assembly 300 to display structure 10 and extends rearwardly from intermediate panel 304, in the illustrated embodiments. Alternatively, back frame 306 is coupled directly to front frame 302 and intermediate panel 304 is eliminated. In an embodiment, back frame 306 includes top rails 330 and 332 and side rails 334 and 336. Top rails 330 and 332 are L-shaped and spaced a distance apart from each other to form a top support member. In an embodiment, each of top rails 330 and 332 includes a first planar portion 338 and 340 extending axially from and substantially perpendicularly relative to intermediate panel 304 and horizontally along a top portion of an outer peripheral section of intermediate panel 304. First planar portions 338 and 340 each have a width that is substantially equal to a width of top wall 208 of frame section 200. Second planar portions 342 and 344 extend substantially perpendicular relative to and from an edge of a corresponding first planar portion 338 or 340 so that top rails 330 and 332 can be hung onto top wall 208 of frame section 200.

Side rails 334 and 336 are L-shaped and include first planar portions 346 and 348 and second planar portions 350 and 352. First planar portions 346 and 348 extend substantially perpendicularly relative to intermediate panel 304 and vertically alongside portions of the outer peripheral section of intermediate panel 304, and second planar portions 350 and 352 extend substantially perpendicular to and along an edge of corresponding first planar portions 346 and 348. First planar portions 346 and 348 are sufficiently spaced apart and such that sidewalls 212 and 214 of frame section 200 can be positioned therebetween. Additionally, first planar portions 346 and 348 extend a distance away from intermediate panel 304 that is substantially equal to or larger than a width of corresponding sidewall 212 and 214.

End frame assemblies 14 and 1114 increase display area on display structures. Additionally, in some examples, end frame assemblies provide display structures with eye-catching and/or finished appearances, which may encourage traffic toward certain displayed product. Because lower connection assemblies 124 or 1124 are readily adjustable, end frame assemblies 14 and 1114 are not restricted to coupling to vertical structures of a single, distinct size and/or configuration and can easily be removed or added depending upon the desired end aesthetic appearance of display structure 10.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. An end frame assembly for use with a display unit including a post having at least one aperture formed through each of two opposing surfaces of the post, the end frame assembly comprising:

an end frame having a lower support member;

a first stationary plate coupled to the lower support member;

a second stationary plate couple to the lower support member and spaced from and extending substantially coplanarly with respect to the first stationary plate;

a first slide plate disposed over the first stationary plate and including a first tab configured to fit within one of the at least one aperture formed through one of the two opposing surfaces of the post, wherein the first slide plate is selectively coupled with the first stationary plate via at least a first fastener, and the first fastener is selectively releaseable to selectively allow linear movement of the first slide plate relative to the first stationary plate and the post and selectively securable to hold the first slide plate in a substantially static position relative to the first stationary plate; and a second slide plate disposed over the second stationary plate and including a second tab configured to fit within one of the at least one aperture formed through the other one of the two opposing surfaces of the post;

wherein each of the first tab and the second tab is positioned on an end of a corresponding one of the first slide plate and the second slide plate nearest the other of the first slide plate and the second slide plate.

2. The end frame assembly of claim 1, wherein the first slide plate includes a flange opposite the first tab to facilitate a user in grasping the first slide plate.

3. The end frame assembly of claim 2, wherein the flange is formed substantially perpendicularly to the first slide plate and extends upwardly relative to the first slide plate.

4. The end frame assembly of claim 1, further comprising:

a connector piece extending between the first stationary plate and the second stationary plate, wherein the connector piece has a transverse dimension that is smaller than a transverse dimension of each of the first stationary plate and the second stationary plate such that an open space between the first stationary piece and the second stationary piece is maintained for receiving the post.

5. The end frame assembly of claim 1, wherein each of the first stationary plate and the first slide plate define a different one of an opening and an elongated slot, and the first fastener is configured to move linearly in the elongated slot when released to selectively allow linear movement of the first slide plate relative to the first stationary plate to adjust the position of the first tab relative to the post.

6. The end frame assembly of claim 5, wherein the first fastener is linearly movable within the elongated slot between a first position maintaining the first slide plate such that the tab is placed within one of the at least one aperture formed in the one of the two opposing surfaces of the post and a second position maintaining the first slide plate such that the tab is spaced from the post.

7. The end frame assembly of claim 5, wherein the opening is substantially circular and has a diameter substantially equal to a diameter of the first fastener, and the elongated slot has a width substantially equal to a diameter of the first fastener and a length greater than the diameter of the first fastener and equal to or greater than a length of the first tab.

8. The end frame assembly of claim 1, wherein each of the first tab of the first slide plate and the second tab of the second slide plate is tapered toward the other of the first slide plate and the second slide plate.

9. The end frame assembly of claim 1, wherein each of the first tab of the first slide plate and the second tab of the second slide plate includes a semi-circular edge facing the other of the first slide plate and the second slide plate.

10. The end frame assembly of claim 1, wherein each of the first slide plate and the second slide plate is substantially equally sized and shaped in at least two dimensions to the corresponding one of the first stationary plate and the second stationary plate.

11. The end frame assembly of claim 1, wherein the second slide plate is selectively coupled with the second stationary plate via at least a second fastener, and the at least the second fastener is readily releasable to selectively allow linear movement of the second slide plate relative to the second stationary plate and the post and readily securable to hold the second slide plate in a substantially static position relative to the second stationary plate.

12. The end frame assembly of claim 1, wherein the end frame substantially extends in a plane perpendicular to each of the first stationary plate and the second stationary plate and substantially parallel to the post.

13. The end frame assembly of claim 1, further comprising a connection member coupled with the end frame opposite the first stationary plate and the second stationary plate, the connection member including a primary plate and two opposing side overhangs extending substantially perpendicularly from opposing ends of the primary plate, wherein the primary plate is configured to be placed over a top surface of the post such that each of the two opposing side overhangs is positioned directly adjacent a different one of the two opposing surfaces of the post.

14. The end frame assembly of claim 1, wherein:

the end frame defines an end frame opening and includes at least two opposing, elongated tracks on opposite sides of the end frame opening, the end frame assembly further comprises a display panel being substantially planar and defining a first edge opposite a second edge, and the first edge and the second edge are each maintained in a different one of the at least two opposing tracks of the end frame such that the display panel extends over and substantially covers the end frame opening.

15. The end frame assembly of claim 14, wherein the end frame defines a slot providing access through the end frame to the at least two opposing, elongated tracks, and the display panel is readily removable from or replaceable into the at least two opposing, elongated tracks via the slot.

16. The end frame assembly of claim 1, wherein:

the end frame further comprises an upper wall opposite the lower support member and two opposing sidewalls extending between the upper wall and the lower support member, the end frame assembly further comprises:

a front frame providing a decorative front surface, and a rear frame secured to the first frame opposite the decorative front surface, the rear frame including at least a top rail and two opposing side rails, the top rail of the rear frame receives the upper wall of the end frame, and each of the two opposing side rails of the rear frame slidably receives a different one of the two opposing sidewalls of the end frame to substantially cover the end frame.

17. The end frame assembly of claim 1, in combination with the display unit including the post, wherein the end frame assembly is adjustable between a position coupled with the post, in which both the first tab is placed within one of the at least one aperture formed through the one of the two opposing surfaces of the post and the second tab is placed within one of the at least one aperture formed through the other one of the two opposing surfaces of the post, and a position uncoupled with the post, in which both of the first tab and the second tab are spaced from the post.

18. The combination of claim 17, wherein the display unit defines a horizontal surface extending adjacent the post, and the first stationary plate and the second stationary plate each are positioned to extend over and directly contact the horizontal surface.

19. A method of installing an end frame assembly on a substantially vertical post of a display unit, the method comprising:

providing an end frame assembly comprising:

an end frame having a lower support member, a first stationary plate coupled to the lower support member, a second stationary plate coupled to the lower support member and spaced from and extending substantially coplanarly with respect to the first stationary plate, a first slide plate disposed over the first stationary plate and including a first tab, wherein the first slide plate is selectively coupled with the first stationary plate via at least a first fastener, and a second slide plate disposed over the second stationary plate and including a second tab;

positioning the end frame assembly adjacent the substantially vertical post of the display unit in a retail setting such that the first stationary plate extends from one of two opposing surfaces of the post away from the post and the second stationary plate extends from the other one of the two opposing surfaces of the post away from the post;

sliding the first slide plate relative to the first stationary plate to position the first tab within an opening defined through the one of the two opposing surfaces of the substantially vertical post to at least partially couple the end frame assembly to the substantially vertical post, wherein the sliding occurs when the first fastener is released; and adjusting the first fastener to secure the first slide plate in position relative to the first stationary plate while the first tab is positioned within the opening defined through the one of the two opposing surfaces of the substantially vertical post.

20. The method of claim 19, wherein:

the end frame assembly includes an upper connection member opposite the first stationary plate and the second stationary plate, and the method further comprises:

placing the upper connection member of the end frame assembly over a topmost surface of the substantially vertical post, and securing the upper connection member to the topmost surface with a fastener.

* * * * *